US008207848B2

(12) United States Patent
Berger et al.

(10) Patent No.: US 8,207,848 B2
(45) Date of Patent: Jun. 26, 2012

(54) LOCKING SYSTEM FOR SHIPPING CONTAINER INCLUDING BOLT SEAL AND ELECTRONIC DEVICE WITH ARMS FOR RECEIVING BOLT SEAL

(75) Inventors: Thomas R. Berger, Cumming, GA (US); Joseph E. Denny, Atlanta, GA (US)

(73) Assignee: Google Inc., Mountain View, CA (US)

( * ) Notice: Subject to any disclaimer, the term of this patent is extended or adjusted under 35 U.S.C. 154(b) by 405 days.

(21) Appl. No.: 12/468,045

(22) Filed: May 18, 2009

(65) Prior Publication Data

US 2010/0013635 A1 Jan. 21, 2010

Related U.S. Application Data

(63) Continuation-in-part of application No. PCT/US2009/044276, filed on May 16, 2009, and a continuation-in-part of application No. PCT/US2009/044277, filed on May 16, 2009.

(60) Provisional application No. 61/053,665, filed on May 16, 2008, provisional application No. 61/109,494, filed on Oct. 29, 2008, provisional application No. 61/151,168, filed on Feb. 9, 2009, provisional application No. 61/140,882, filed on Dec. 25, 2008, provisional application No. 61/140,887, filed on Dec. 25, 2008, provisional application No. 61/140,888, filed on Dec. 25, 2008, provisional application No. 61/141,021, filed on Dec. 29, 2008, provisional application No. 61/147,917, filed on Jan. 28, 2009, provisional application No. 61/155,887, filed on Feb. 26, 2009.

(51) Int. Cl.
*E05B 45/06* (2006.01)

(52) U.S. Cl. ..... 340/542; 70/101; 340/571; 340/693.9

(58) Field of Classification Search ..... 340/542, 340/571, 693.5, 693.9; 70/91, 101; 292/327
See application file for complete search history.

(56) References Cited

U.S. PATENT DOCUMENTS 4,165,024 A 8/1979 Oswalt et al.

(Continued)

FOREIGN PATENT DOCUMENTS

EP 0467036 1/1992

(Continued)

OTHER PUBLICATIONS

Information Disclosure Statement (IDS) Letter Regarding Common Patent Application(s), dated Mar. 30, 2011.

(Continued)

*Primary Examiner* — Thomas Mullen
(74) *Attorney, Agent, or Firm* — Tillman Wright, PLLC; Chad D. Tillman; Jeremy C. Doerre

(57) ABSTRACT

An electronic locking device secures a shipping container and includes a housing, two arms, a sensing circuit, and electronics. The pair of arms extend from the housing and couple to the hasp. The arms transition between locked and unlocked configurations relative to the hasp, with one or both of the arms pivoting relative to the other. A bolt seal locks the arms in the locked configuration. The sensing circuit, which includes sensing contacts, is in a "closed" state or "open" state depending on whether the arms are in the locked or unlocked configuration. The electronics record and report the state of the sensing circuit, thereby indicating whether the arms are locked or unlocked.

21 Claims, 12 Drawing Sheets

U.S. PATENT DOCUMENTS 4,688,244 A 8/1987 Hannon et al.
4,750,197 A 6/1988 Denekamp et al.
4,807,224 A 2/1989 Naron et al.
4,817,537 A 4/1989 Cripe et al.
5,424,720 A 6/1995 Kirkpatrick
5,565,858 A 10/1996 Guthrie
5,598,142 A 1/1997 Winner, Jr.
5,648,763 A * 7/1997 Long ..... 340/5.73
5,656,996 A 8/1997 Houser
5,682,379 A 10/1997 Mahany et al.
5,719,771 A 2/1998 Buck et al.
5,835,012 A 11/1998 Wilk
5,892,441 A 4/1999 Woolley
5,907,491 A 5/1999 Canada et al.
5,913,180 A 6/1999 Ryan
5,917,423 A 6/1999 Duvall
5,917,433 A 6/1999 Keillor et al.
5,939,982 A 8/1999 Gagnon et al.
5,959,568 A 9/1999 Woolley
5,977,913 A 11/1999 Christ
6,046,675 A 4/2000 Hanna
6,125,306 A 9/2000 Shimada et al.
6,127,928 A 10/2000 Issacman
6,127,976 A 10/2000 Boyd et al.
6,134,587 A 10/2000 Okanoue
6,154,658 A 11/2000 Caci
6,192,400 B1 2/2001 Hanson et al.
6,225,894 B1 5/2001 Kyrtsos
6,354,493 B1 3/2002 Mon
6,409,082 B1 6/2002 Davis et al.
6,437,692 B1 8/2002 Petite
6,481,222 B1 11/2002 Denniston
6,512,478 B1 1/2003 Chien
6,542,114 B1 4/2003 Eagleson et al.
6,547,137 B1 4/2003 Begelfer et al.
6,559,620 B2 5/2003 Zhou et al.
6,600,418 B2 7/2003 Francis et al.
6,614,349 B1 9/2003 Proctor et al.
6,628,835 B1 9/2003 Brill et al.
6,665,585 B2 12/2003 Kawase
6,700,533 B1 3/2004 Werb et al.
6,720,888 B2 4/2004 Eagleson et al.
6,737,974 B2 5/2004 Dickinson
6,747,558 B1 6/2004 Thorne et al.
6,753,775 B2 6/2004 Auerbach et al.
6,757,262 B1 6/2004 Weisshaar et al.
6,816,063 B2 11/2004 Kubler et al.
6,847,892 B2 1/2005 Zhou et al.
6,870,476 B2 3/2005 Cockburn et al.
6,874,037 B1 3/2005 Abram et al.
6,882,274 B2 4/2005 Richardson et al.
6,892,230 B1 5/2005 Gu et al.
6,900,731 B2 5/2005 Kreiner
6,919,803 B2 7/2005 Breed
6,927,688 B2 8/2005 Tice
6,934,540 B2 8/2005 Twitchell
6,940,392 B2 9/2005 Chan et al.
6,972,682 B2 12/2005 Lareau et al.
7,012,529 B2 3/2006 Sajkowsky
7,038,585 B2 5/2006 Hall
7,072,668 B2 7/2006 Chou
7,088,229 B2 8/2006 Johnson
7,098,784 B2 8/2006 Easley et al.
7,123,599 B2 10/2006 Yano et al.
7,126,470 B2 10/2006 Clift et al.
7,142,121 B2 11/2006 Chan et al.
7,148,800 B2 12/2006 Cunningham
7,148,803 B2 12/2006 Bandy
7,155,238 B2 12/2006 Katz
7,196,622 B2 3/2007 Lambright et al.
7,209,037 B2 4/2007 Webb, Sr.
7,209,771 B2 4/2007 Twitchell
7,212,122 B2 5/2007 Gloekler et al.
7,233,958 B2 6/2007 Weng
7,239,238 B2 7/2007 Tester et al.
7,248,160 B2 7/2007 Mangan et al.
7,253,731 B2 8/2007 Joao
7,270,353 B2 9/2007 Sironi et al.
7,273,172 B2 9/2007 Olsen
7,274,295 B2 9/2007 Koch
7,277,009 B2 10/2007 Hall
7,283,052 B2 10/2007 Bohman
7,299,068 B1 11/2007 Halla
7,313,421 B2 12/2007 Dejanovic
7,315,281 B2 1/2008 Dejanovic
7,317,382 B2 1/2008 Pratt
7,319,397 B2 1/2008 Chung
7,323,981 B2 1/2008 Peel
7,333,015 B2 2/2008 Ekstrom
7,339,469 B2 3/2008 Braun
7,340,260 B2 3/2008 McAlexander
7,342,496 B2 3/2008 Muirhead
7,342,497 B2 3/2008 Chung
7,348,875 B2 3/2008 Hughes et al.
7,378,957 B2 5/2008 Twitchell
7,378,958 B2 5/2008 Twitchell
7,378,959 B2 5/2008 Twitchell
7,378,960 B1 5/2008 Binding
7,382,251 B2 6/2008 Bohman
7,394,358 B2 7/2008 Cherry
7,394,372 B2 7/2008 Gloekler
7,397,363 B2 7/2008 Joao
7,417,543 B2 8/2008 Bergman
7,419,101 B2 9/2008 Kawai
7,423,534 B2 9/2008 Dhanjal
7,423,535 B2 9/2008 Chung
7,438,334 B2 10/2008 Terry
7,440,781 B2 10/2008 Beach et al.
7,482,920 B2 1/2009 Joao
7,528,719 B2 5/2009 Hopman
7,538,672 B2 5/2009 Lockyer et al.
7,595,727 B2 9/2009 Grijalva et al.
7,782,200 B1 8/2010 Fleischmann
7,986,238 B2 7/2011 Cho
8,068,807 B2 11/2011 Twitchell
2002/0030596 A1 3/2002 Finn et al.
2002/0050932 A1 5/2002 Rhoades et al.
2002/0089434 A1 7/2002 Ghazarian
2002/0093982 A1 7/2002 Joy et al.
2002/0098861 A1 7/2002 Doney et al.
2002/0099567 A1 7/2002 Joao
2002/0130778 A1 9/2002 Nicholson
2003/0011474 A1 1/2003 Ng
2003/0132853 A1 7/2003 Ebert
2003/0141973 A1 7/2003 Yeh et al.
2003/0179073 A1 9/2003 Ghazarian
2003/0182077 A1 9/2003 Emord
2003/0189491 A1 10/2003 Ng
2003/0209601 A1 11/2003 Chung
2004/0021572 A1 2/2004 Schoen et al.
2004/0041706 A1 3/2004 Stratmoen et al.
2004/0041731 A1 3/2004 Hisano
2004/0100379 A1 5/2004 Boman et al.
2004/0100394 A1 5/2004 Hitt
2004/0100415 A1 5/2004 Veitch et al.
2004/0119588 A1 6/2004 Marks
2004/0135691 A1 7/2004 Duron et al.
2004/0174259 A1 9/2004 Peel
2004/0183673 A1 9/2004 Nageli
2004/0215532 A1 10/2004 Boman et al.
2004/0233041 A1 11/2004 Bohman et al.
2004/0233054 A1 11/2004 Neff et al.
2005/0073406 A1 4/2005 Easley et al.
2005/0088299 A1 4/2005 Bandy et al.
2005/0099292 A1 5/2005 Sajkowsky
2005/0128080 A1 6/2005 Hall et al.
2005/0154527 A1 7/2005 Ulrich
2005/0226201 A1 10/2005 McMillin
2006/0132485 A1 6/2006 Milinusic
2006/0158326 A1 7/2006 Easley et al.
2006/0164232 A1 7/2006 Waterhouse et al.
2006/0164239 A1 7/2006 Loda
2006/0187026 A1 8/2006 Kochis
2006/0202817 A1 9/2006 Mackenzie et al.
2006/0255934 A1 11/2006 Easley et al.
2007/0008408 A1 1/2007 Zehavi
2007/0032951 A1 2/2007 Tanenhaus et al.

| | | | | |
|---|---|---|---|---|
| 2007/0040732 | A1 | 2/2007 | Burgett | |
| 2007/0044524 | A1 | 3/2007 | Coutermarsh et al. | |
| 2007/0113882 | A1 | 5/2007 | Meyers | |
| 2007/0115114 | A1 | 5/2007 | Meyers | |
| 2007/0115115 | A1 | 5/2007 | Meyers | |
| 2007/0115859 | A1 | 5/2007 | Meyers | |
| 2007/0118332 | A1 | 5/2007 | Meyers | |
| 2007/0121557 | A1 | 5/2007 | Sylvain | |
| 2007/0133980 | A1 | 6/2007 | Meyers | |
| 2007/0139197 | A1 | 6/2007 | Hopman | |
| 2007/0152815 | A1 | 7/2007 | Meyers | |
| 2007/0200765 | A1 | 8/2007 | Meyers | |
| 2008/0066658 | A1 | 3/2008 | Muirhead | |
| 2008/0094209 | A1 | 4/2008 | Braun | |
| 2008/0117040 | A1 | 5/2008 | Peel | |
| 2008/0180252 | A1 | 7/2008 | Vogt | |
| 2008/0234878 | A1 | 9/2008 | Joao | |
| 2008/0264888 | A1 | 10/2008 | Zakula et al. | |
| 2008/0315596 | A1 | 12/2008 | Terry | |
| 2009/0146805 | A1 | 6/2009 | Joao | |
| 2009/0217718 | A1 * | 9/2009 | Porter | 70/271 |
| 2009/0290512 | A1 | 11/2009 | Twitchell | |
| 2009/0295564 | A1 | 12/2009 | Twitchell | |
| 2009/0322510 | A1 | 12/2009 | Berger et al. | |
| 2010/0214060 | A1 | 8/2010 | Twitchell | |

FOREIGN PATENT DOCUMENTS

| | | | |
|---|---|---|---|
| EP | 0748083 | | 12/1996 |
| EP | 0748085 | | 12/1996 |
| EP | 0829995 | | 3/1998 |
| EP | 1317733 | | 6/2003 |
| EP | 1692599 | | 8/2006 |
| EP | 1692668 | | 8/2006 |
| KR | 10-20040012311 | A | 2/2004 |
| KR | 10-0509070 | B1 | 8/2005 |
| KR | 10-0587735 | | 6/2006 |
| KR | 10-2008-0001235 | A | 1/2008 |
| WO | 200068907 | | 11/2000 |
| WO | 2003098175 | | 11/2003 |
| WO | 2009140669 | A2 | 11/2009 |
| WO | 2009140669 | A3 | 11/2009 |
| WO | 2009151877 | A2 | 12/2009 |
| WO | 2009151877 | A3 | 12/2009 |

OTHER PUBLICATIONS

"International Search Report" and "Written Opinion of the International Search Authority" (Korean Intellectual Property Office) in Terahop Networks, Inc. et al., International Patent Application Serial No. PCT/US2009/044277, dated Jan. 27, 2010, 13 pages.

"International Search Report" and "Written Opinion of the International Search Authority" (Korean Intellectual Property Office) in Terahop Networks, Inc. et al., International Patent Application Serial No. PCT/US2009/044276, dated Jan. 11, 2010, 7 pages.

* cited by examiner

110

512

512

LOCKING SYSTEM FOR SHIPPING CONTAINER INCLUDING BOLT SEAL AND ELECTRONIC DEVICE WITH ARMS FOR RECEIVING BOLT SEAL

CROSS-REFERENCE TO RELATED APPLICATION

The present application is a continuation-in-part of, and claims priority under 35 U.S.C. §120 to, each of: international patent applications PCT/US09/44276 and PCT/US09/44277, both filed May 16, 2009. The present application also is a nonprovisional of, and claims priority under 35 U.S.C. §119 (e) to, each of: U.S. provisional patent application 61/053,665, filed May 16, 2008; U.S. provisional patent application 61/109,494, filed Oct. 29, 2008; and U.S. provisional patent application 61/151,168, filed Feb. 9, 2009. The present application further is a nonprovisional application of, and claims priority under §119(e) to, each of U.S. provisional patent application Nos. 61/140,882 filed Dec. 25, 2008; 61/140,887 filed Dec. 25, 2008; 61/140,888 filed Dec. 25, 2008; 61/141,021 filed Dec. 29, 2008; 61/147,917 filed Jan. 28, 2009; and 61/155,887 filed Feb. 26, 2009. Each of these international applications and provisional applications from which priority is claimed, and the disclosures thereof, are incorporated herein by reference.

Additionally, the present application hereby incorporates herein by reference each of the following identified U.S. patent applications—as well as any publications thereof and any patents issuing therefrom; the following identified U.S. patent application publications; and the following identified U.S. patents: Ser. No. 12/367,544 (US 2009-0135000) now U.S. Pat. No. 7,830,852; Ser. No. 12/367,543 (US 2009-0161642) now U.S. Pat. No. 7,940,719; Ser. No. 12/367,542 (US 2009-0181623) now U.S. Pat. No. 7,746,838; Ser. No. 12/353,197 (US 2009-0129306); Ser. No. 12/352,992 (US 2009-0122737); Ser. No. 12/343,865 (US 2009-0104902 A1) now U.S. Pat. No. 7,830,850; Ser. No. 12/343,822 (US 2009-0103462 A1) now U.S. Pat. No. 7,904,071; Ser. No. 12/271,850 (US 2009-0092082 A1); Ser. No. 12/140,253 (US 2008-0303897 A1); Ser. No. 11/930,797 (US 2008-0151850 A1) now U.S. Pat. No. 7,940,736; Ser. No. 11/930,793 (US 2008-0112378 A1) now U.S. Pat. No. 7,940,717; Ser. No. 11/930,788 (US 2008-0165749 A1); Ser. No. 11/930,785 (US 2008-0143484 A1) now abandoned; Ser. No. 11/930,782 (US 2008-0212544 A1) now abandoned; Ser. No. 11/930,779 (US 2008-0129458 A1) now abandoned; Ser. No. 11/930,777 (US 2008-0111692 A1); Ser. No. 11/930,770 (US 2008-0144554 A1) now abandoned; Ser. No. 11/930,761 (US 2008-0112377 A1); Ser. No. 11/930,753 (US 2008-0142592 A1) now U.S. Pat. No. 7,535,339; Ser. No. 11/930,749 (US 2008-0130536 A1) now U.S. Pat. No. 7,538,658; Ser. No. 11/930,740 (US 2008-0150723 A1) now U.S. Pat. No. 7,538,657; Ser. No. 11/930,736 (US 2008-0143483 A1) now U.S. Pat. No. 7,538,656; Ser. No. 11/847,309 (US 2007-0291724 A1); Ser. No. 11/847,295 (US 2007-0291690 A1) now U.S. Pat. No. 8,068,807; Ser. No. 11/832,998 (US 2007-0273503 A1) now U.S. Pat. No. 7,378,959; Ser. No. 11/832,991 (US 2007-0268134 A1) now U.S. Pat. No. 7,378,958; Ser. No. 11/832,979 (US 2007-0268126 A1) now U.S. Pat. No. 7,378,957; Ser. No. 11/610,427 (US 2007-0159999 A1) now U.S. Pat. No. 7,733,818; Ser. No. 11/618,931 (US 2007-0155327 A1) now U.S. Pat. No. 7,907,941; Ser. No. 11/555,173 (US 2007-0099629 A1) now U.S. Pat. No. 7,742,773; Ser. No. 11/555,164 (US 2007-0099628 A1) now U.S. Pat. No. 7,742,772; Ser. No. 11/465,466 (US 2007-0043807 A1) now U.S. Pat. No. 7,940,716; Ser. No. 11/465,796 (US 2007-0041333 A1) now U.S. Pat. No. 7,705,747; Ser. No. 11/460,976 (US 2008-0315596 A1) 7,828,342; Ser. No. 11/428,536 (US 2007-0002793 A1) now U.S. Pat. No. 7,940,716; Ser. No. 11/428,535 (US 2007-0002792 A1); Ser. No. 11/425,047 (US 2007-0069885 A1) now U.S. Pat. No. 7,554,442; Ser. No. 11/425,040 (US 2006-0287008 A1) now U.S. Pat. No. 7,539,520; Ser. No. 11/424,850 (US 2007-0004331 A1) now U.S. Pat. No. 7,783,246; Ser. No. 11/424,849 (US 2007-0004330 A1) now U.S. Pat. No. 7,574,168; Ser. No. 11/424,847 (US 2007-0001898 A1) now U.S. Pat. No. 7,583,769; Ser. No. 11/424,845 (US 2006-0287822 A1) now U.S. Pat. No. 7,574,300; Ser. No. 11/423,127 (US 2006-0289204 A1) now U.S. Pat. No. 7,563,991; Ser. No. 11/422,306 (US 2006-0282217 A1) now U.S. Pat. No. 7,542,849; Ser. No. 11/422,304 (US 2006-0276963 A1) now U.S. Pat. No. 7,526,381; Ser. No. 11/422,321 (US 2006-0276161 A1) now U.S. Pat. No. 7,650,135; Ser. No. 11/422,329 (US 2006-0274698 A1) now U.S. Pat. No. 7,529,547; Ser. No. 11/306,765 (US 2008-0136624 A1) now U.S. Pat. No. 7,394,361; Ser. No. 11/306,764 (US 2006-0237490 A1) now U.S. Pat. No. 7,391,321; Ser. No. 11/193,300 (US 2007-0024066 A1) now U.S. Pat. No. 7,438,334; Ser. No. 11/161,550 (US 2007-0002808 A1) now U.S. Pat. No. 7,430,437; Ser. No. 11/161,545 (US 2006-0018274 A1) now U.S. Pat. No. 7,221,668; Ser. No. 11/161,542 (US 2006-0023679 A1) now U.S. Pat. No. 7,522,568; Ser. No. 11/161,540 (US 2007-0004431 A1) now U.S. Pat. No. 7,200,132; Ser. No. 11/161,539 (US 2006-0023678 A1) now U.S. Pat. No. 7,209,468; Ser. No. 10/987,964 (US 2005-0093703 A1) now U.S. Pat. No. 7,155,264; Ser. No. 10/987,884 (US 2005-0093702 A1) now U.S. Pat. No. 7,133,704; Ser. No. 10/604,032 (US 2004-0082296 A1) now U.S. Pat. No. 6,934,540; Ser. No. 10/514,336 (US 2005-0215280 A1) now U.S. Pat. No. 7,209,771; and Ser. No. 09/681,282 (US 2002-0119770 A1) now U.S. Pat. No. 6,745,027.

Each of these foregoing patent properties is hereby incorporated herein by reference for purposes of disclosure of common designation ("CD") technology (such as, e.g., class-based network ("CBN") technology); wake-up ("WU") technology; and networks and systems that utilize such technologies, such as those of TeraHop Networks ("THN"), Inc. of Alpharetta, Ga. It is intended that the CD/CBN and WU technologies—and related features, improvements, and enhancements—as disclosed in these incorporated patent references may be utilized in combination with various embodiments and implementations of the present invention.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to shipping containers.

Shipping containers today have their doors "locked" by using an ISO standard mechanical bolt seal. In this arrangement, a bolt with a unique (to the manufacturer) serial numbered bolt is inserted into the right hand container door lock hasp and is secured in-place with a bolt housing containing the same serial number. The bolt needs to be cut with bolt cutters to be removed. Although there is an ISO standard for these bolts, they are not necessarily identical from one manufacturer to another. Variations include the length and diameter of the bolt and the mechanical locking mechanism that secures the bolt to its mated housing.

The abovementioned products and concepts have been universally accepted by industry. Although far from fool proof, the technique does provide a simple method of keeping the doors on shipping containers closed unless deliberate action is taken to cut the bolt. It is quite common for bolts to be cut and containers opened and then re-sealed as the containers travel from origin to destination. Unfortunately, there is no means readily available for determining when or where bolts were cut and replaced. Without this knowledge, an end shipper has no recourse to determine when a container bolt has been removed and replaced. Theft or loss assignment, therefore, can be difficult at best.

A need exists for improvement in securing, monitoring, and tracking shipping containers. This, and other needs, are addressed by one or more aspects of the present invention.

SUMMARY OF THE INVENTION

The invention generally relates to networks, apparatus, methods and systems for securing, monitoring and tracking shipping containers.

The present invention includes many aspects and features. Moreover, while many aspects and features relate to, and are described in, the context of securing for shipping containers, the present invention is not limited to use only in shipping containers, as will become apparent from the following summaries and detailed descriptions of aspects, features, and one or more embodiments of the present invention.

Accordingly, one aspect of the present invention relates to an electronic locking device for securing a shipping container. An exemplary such device includes a housing including an electronics compartment; a pair of arms, extending from the housing and adapted to couple to a hasp on a shipping container, wherein at least one of the arms is configured to pivot, relative to the other of the arms, such that the arms transition between a locked configuration and an unlocked configuration; a sensing circuit that is in a "closed" state when the pair of arms are in the locked configuration and is in an "open" state when the pair of arms is in the unlocked configuration; and electronics housed in the electronics compartment that detect whether the sensing circuit is in the "closed" state or the "open" state. Furthermore, in this aspect of the invention, the output of the electronics represents an indication of whether the arms are in the locked configuration or the unlocked configuration.

In a feature of this aspect of the invention, the housing further includes a support carriage and a barrier to prevent access to the electronics enclosure from the support carriage. In another feature, the electronics record the state of the sensing circuit. In a further feature, the electronics record the state of the sensing circuit in computer-readable medium that is contained in the electronics compartment. In still another feature, the electronics report the state of the sensing circuit. In a further feature still, the electronics report the state of the sensing circuit through wireless communications. In an additional feature, the housing comprises a rugged mechanical housing. In yet another feature, the arms are configured to concurrently receive a bolt therethrough when in the locked configuration. In another feature, a bolt of a bolt seal extends through a respective opening in each of the arms and retains the arms in the locked configuration.

In another feature of this aspect of the invention, a bolt extends from a first arm, of the pair of arms, and is configured to extend through an opening of a hasp for coupling of the device to the hasp. In another feature, in the locked configuration, the presence of the bolt, extending through the hasp, prevents the hasp from being opened. In still a further feature, the second arm includes a bolt receptacle adapted to receive the distal end of the bolt therein and wherein, in the locked configuration, the distal end of the bolt is located within and protected by the bolt receptacle. In yet another feature, the second arm includes a bolt receptacle adapted to receive and retain in locking engagement therewith the distal end of the bolt. In an additional feature, the arms are configured to be maintained in the locked configuration by a bolt seal.

In another feature of this aspect of the invention, the sensing circuit includes sensing contacts located in or on the pair of arms. In yet another feature, a sensing contact on one of the arms comes into contact with, or sufficient close to, a sensing contact on the other arm when the arms are in the locked configuration. In a further feature, a first arm pivots around a point within the support carriage; the second arm is fixed in place; the sensing circuit includes sensing contacts that extend from portions of the arms interior the housing; a bolt is attached to and projects from one of the arms and is located exterior the housing; and a bolt receptacle is attached to and projects from the other of the arms exterior to the housing, and is configured to receive therein the projecting bolt when the arms are in the locked configuration. In another feature, each of the arms has an opening configured to concurrently receive therethrough a bolt of a bolt seal.

In another feature of this aspect of the present invention, the arms pivot about pivot axes within the housing; the sensing circuit includes sensing contacts that extend from portions of the arms interior the housing; a bolt is attached to and projects from one of the arms and is located exterior the housing; and a bolt receptacle is attached to and projects from the other of the arms exterior to the housing. In a further feature, each of the arms has an opening configured to concurrently receive therethrough a bolt of a bolt seal. In a further feature still, the bolt seal openings are located further from the housing along the arms than the location of the bolt and bolt receptacle. In a different feature, the bolt and bolt receptacle are located further from the housing along the arms than the location of the bolt seal openings. In yet a different feature, both arms pivot about respective pivot axes within the housing, and wherein the pivot axes are located between sensing contacts of the sensing circuit and the bolt and bolt receptacle. In a further feature, the arms are carried by a pivot arm assembly that is removably received and retained within the housing.

In yet another feature, the device includes a spring located within the housing and configured to bias the arms toward the unlocked configuration. In still another feature, a bolt extends from a first arm, of the pair of arms, and is adapted to extend through the hasp; in the locked configuration, the presence of the bolt, extending through the hasp, prevents the hasp from being opened; the second arm includes a bolt receptacle adapted to receive and retain the distal end of the bolt; and the securing of the bolt within the bolt receptacle provides a force sufficient to retain the arms in the locked configuration against the force of the spring.

Another aspect of the present invention relates to an electronic system for securing a shipping container. An exemplary such system includes a hasp adapted for use in securing a shipping container; a bolt seal; and an electronic locking device having a housing including an electronics compartment, a pair of arms, extending from the housing and adapted to couple to the hasp, wherein at least one of the arms is configured to pivot, relative to the other of the arms, such that the arms transition between a locked configuration and an unlocked configuration, a sensing circuit that is in a "closed" state when the pair of arms are in the locked configuration and is in the "open" state when the pair of arms is in the unlocked configuration, and electronics housed in the electronics compartment that detect whether the sensing circuit is in the "closed" state or the "open" state. Furthermore, the output of the electronics represents an indication of whether the arms are in the locked configuration or the unlocked configuration.

In a feature of this aspect of the invention, the housing further includes a support carriage and a barrier to prevent access to the electronics enclosure from the support carriage. In another feature, the electronics record the state of the sensing circuit. In a further feature, the electronics record the state of the sensing circuit in computer-readable medium that is contained in the electronics compartment. In still another feature, the electronics report the state of the sensing circuit. In a further feature still, the electronics report the state of the sensing circuit through wireless communications. In an additional feature, the housing comprises a rugged mechanical housing. In yet another feature, the arms are configured to concurrently receive a bolt therethrough when in the locked configuration. In another feature, a bolt of a bolt seal extends through a respective opening in each of the arms and retains the arms in the locked configuration.

In another feature of this aspect of the invention, a bolt extends from a first arm, of the pair of arms, and is configured to extend through an opening of a hasp for coupling of the device to the hasp. In another feature, in the locked configuration, the presence of the bolt, extending through the hasp, prevents the hasp from being opened. In still a further feature, the second arm includes a bolt receptacle adapted to receive the distal end of the bolt therein and wherein, in the locked configuration, the distal end of the bolt is located within and protected by the bolt receptacle. In yet another feature, the second arm includes a bolt receptacle adapted to receive and retain in locking engagement therewith the distal end of the bolt. In an additional feature, the arms are configured to be maintained in the locked configuration by a bolt seal.

In another feature of this aspect of the invention, the sensing circuit includes sensing contacts located in or on the pair of arms. In yet another feature, a sensing contact on one of the arms comes into contact with, or sufficient close to, a sensing contact on the other arm when the arms are in the locked configuration. In a further feature, a first arm pivots around a point within the support carriage; the second arm is fixed in place; the sensing circuit includes sensing contacts that extend from portions of the arms interior the housing; a bolt is attached to and projects from one of the arms and is located exterior the housing; and a bolt receptacle is attached to and projects from the other of the arms exterior to the housing, and is configured to receive therein the projecting bolt when the arms are in the locked configuration. In another feature, each of the arms has an opening configured to concurrently receive therethrough a bolt of a bolt seal.

In another feature of this aspect of the present invention, the arms pivot about pivot axes within the housing; the sensing circuit includes sensing contacts that extend from portions of the arms interior the housing; a bolt is attached to and projects from one of the arms and is located exterior the housing; and a bolt receptacle is attached to and projects from the other of the arms exterior to the housing. In a further feature, each of the arms has an opening configured to concurrently receive therethrough a bolt of a bolt seal. In a further feature still, the bolt seal openings are located further from the housing along the arms than the location of the bolt and bolt receptacle. In a different feature, the bolt and bolt receptacle are located further from the housing along the arms than the location of the bolt seal openings. In yet a different feature, both arms pivot about respective pivot axes within the housing, and wherein the pivot axes are located between sensing contacts of the sensing circuit and the bolt and bolt receptacle. In a further feature, the arms are carried by a pivot arm assembly that is removably received and retained within the housing.

In yet another feature, the system includes a spring located within the housing and configured to bias the arms toward the unlocked configuration. In still another feature, a bolt extends from a first arm, of the pair of arms, and is adapted to extend through the hasp; in the locked configuration, the presence of the bolt, extending through the hasp, prevents the hasp from being opened; the second arm includes a bolt receptacle adapted to receive and retain the distal end of the bolt; and the securing of the bolt within the bolt receptacle provides a force sufficient to retain the arms in the locked configuration against the force of the spring.

Another aspect of the present invention relates to a method for securing a shipping container. An exemplary such method includes providing an electronic locking device, comprising a housing including an electronics compartment, a pair of arms, extending from the housing, a sensing circuit, and electronics housed in the electronics compartment and coupled to the sensing circuit; configuring the electronic locking device from a locked configuration to an unlocked configuration by pivoting at least one of the arms away from the other arm; as a function of the at least one arm being pivoted away from the other arm, placing the sensing circuit in an "open" state; recognizing, by the electronics, the "open" state of the sensing circuit; generating, by the electronics, an output indicating the "open" state of the sensing circuit; positioning the electronic locking device in proximity to a hasp on a shipping container; coupling the arms to the hasp on the shipping container by pivoting at least one of the arms towards the other arm from the unlocked configuration into the locked configuration; as a function of the at least one arm being pivoted toward the other arm, placing the sensing circuit in a "closed" state; recognizing, by the electronics, the "closed" state of the sensing circuit; and generating, by the electronics, an output indicating the "closed" state of the sensing circuit.

A feature of this aspect of the invention includes a further step of locking the electronic locking device in the locked configuration with a bolt seal. Another feature includes the step of locking the electronic locking device in the locked configuration with a bolt seal includes inserting a bolt of the bolt seal through respective openings on the arms. In yet another feature, the method includes a step of translating the output to indicate whether the arms were in the locked configuration or the unlocked configuration. In a further feature, the method includes the step of placing the sensing circuit in an "open" state is effectuated by separating a sensing contact on one arm from a sensing contact on the other arm.

Another aspect of the present invention relates to a system for securing, monitoring and tracking shipping containers. An exemplary such system includes a hasp adapted for use in securing a shipping container; and an electronic locking device having a housing including an electronics compartment, a pair of arms, extending from the housing and adapted to couple to the hasp, wherein at least one of the arms is configured to pivot, relative to the other of the arms, such that the arms transition between a locked configuration and an unlocked configuration, a sensing circuit that is in a "closed" state when the pair of arms are in the locked configuration and is in an "open" state when the pair of arms is in the unlocked configuration, and electronics housed in the electronics compartment that detect whether the sensing circuit is in the "closed" state or the "open" state. Furthermore, the output of the electronics represents an indication of whether the arms are in the locked configuration or the unlocked configuration.

In a feature of this aspect of the invention, the housing further includes a support carriage and a barrier to prevent access to the electronics enclosure from the support carriage. In another feature, the electronics record the state of the sensing circuit. In a further feature, the electronics record the state of the sensing circuit in computer-readable medium that is contained in the electronics compartment. In still another feature, the electronics report the state of the sensing circuit. In a further feature still, the electronics report the state of the sensing circuit through wireless communications. In an additional feature, the housing comprises a rugged mechanical housing. In yet another feature, the arms are configured to concurrently receive a bolt therethrough when in the locked configuration. In another feature, a bolt of a bolt seal extends through a respective opening in each of the arms and retains the arms in the locked configuration.

In another feature of this aspect of the invention, a bolt extends from a first arm, of the pair of arms, and is configured to extend through an opening of a hasp for coupling of the device to the hasp. In another feature, in the locked configuration, the presence of the bolt, extending through the hasp, prevents the hasp from being opened. In still a further feature, the second arm includes a bolt receptacle adapted to receive the distal end of the bolt therein and wherein, in the locked configuration, the distal end of the bolt is located within and protected by the bolt receptacle. In yet another feature, the second arm includes a bolt receptacle adapted to receive and retain in locking engagement therewith the distal end of the bolt. In an additional feature, the arms are configured to be maintained in the locked configuration by a bolt seal.

In another feature of this aspect of the invention, the sensing circuit includes sensing contacts located in or on the pair of arms. In yet another feature, a sensing contact on one of the arms comes into contact with, or sufficient close to, a sensing contact on the other arm when the arms are in the locked configuration. In a further feature, a first arm pivots around a point within the support carriage; the second arm is fixed in place; the sensing circuit includes sensing contacts that extend from portions of the arms interior the housing; a bolt is attached to and projects from one of the arms and is located exterior the housing; and a bolt receptacle is attached to and projects from the other of the arms exterior to the housing, and is configured to receive therein the projecting bolt when the arms are in the locked configuration. In another feature, each of the arms has an opening configured to concurrently receive therethrough a bolt of a bolt seal.

In another feature of this aspect of the present invention, the arms pivot about pivot axes within the housing; the sensing circuit includes sensing contacts that extend from portions of the arms interior the housing; a bolt is attached to and projects from one of the arms and is located exterior the housing; and a bolt receptacle is attached to and projects from the other of the arms exterior to the housing. In a further feature, each of the arms has an opening configured to concurrently receive therethrough a bolt of a bolt seal. In a further feature still, the bolt seal openings are located further from the housing along the arms than the location of the bolt and bolt receptacle. In a different feature, the bolt and bolt receptacle are located further from the housing along the arms than the location of the bolt seal openings. In yet a different feature, both arms pivot about respective pivot axes within the housing, and wherein the pivot axes are located between sensing contacts of the sensing circuit and the bolt and bolt receptacle. In a further feature, the arms are carried by a pivot arm assembly that is removably received and retained within the housing.

In yet another feature, the system includes a spring located within the housing and configured to bias the arms toward the unlocked configuration. In still another feature, a bolt extends from a first arm, of the pair of arms, and is adapted to extend through the hasp; in the locked configuration, the presence of the bolt, extending through the hasp, prevents the hasp from being opened; the second arm includes a bolt receptacle adapted to receive and retain the distal end of the bolt; and the securing of the bolt within the bolt receptacle provides a force sufficient to retain the arms in the locked configuration against the force of the spring.

Another aspect of the present invention relates to a method of securing, monitoring and tracking shipping containers. An exemplary such method includes providing an electronic locking device, including a housing including an electronics compartment, a pair of arms, extending from the housing, a sensing circuit, and electronics housed in the electronics compartment and coupled to the sensing circuit; configuring the electronic locking device from a locked configuration to an unlocked configuration by pivoting at least one of the arms away from the other arm; as a function of the at least one arm being pivoted away from the other arm, placing the sensing circuit in an "open" state; recognizing, by the electronics, the "open" state of the sensing circuit; generating, by the electronics, an output indicating the "open" state of the sensing circuit; positioning the electronic locking device in proximity to a hasp on a shipping container; coupling the arms to the hasp on the shipping container by pivoting at least one of the arms towards the other arm from the unlocked configuration into the locked configuration; as a function of the at least one arm being pivoted toward the other arm, placing the sensing circuit in a "closed" state; recognizing, by the electronics, the "closed" state of the sensing circuit; and generating, by the electronics, an output indicating the "closed" state of the sensing circuit.

A feature of this aspect of the invention includes a step of locking the electronic locking device in the locked configuration with a bolt seal. Another feature includes the step of locking the electronic locking device in the locked configuration with a bolt seal includes inserting a bolt of the bolt seal through respective openings on the arms. Yet another feature includes a step of translating the output to indicate whether the arms were in the locked configuration or the unlocked configuration. In still a further feature the step of placing the sensing circuit in an "open" state is effectuated by separating a sensing contact on one arm from a sensing contact on the other arm.

Additional features of the foregoing principal aspects also are set forth elsewhere herein.

In addition to the aforementioned aspects and features of the present invention, it should be noted that the present invention further encompasses the various possible combinations, subcombinations, and permutations of such aspects and features.

BRIEF DESCRIPTION OF THE DRAWINGS

One or more preferred embodiments of the present invention now will be described in detail with reference to the accompanying drawings.

DETAILED DESCRIPTION

Figure 1:
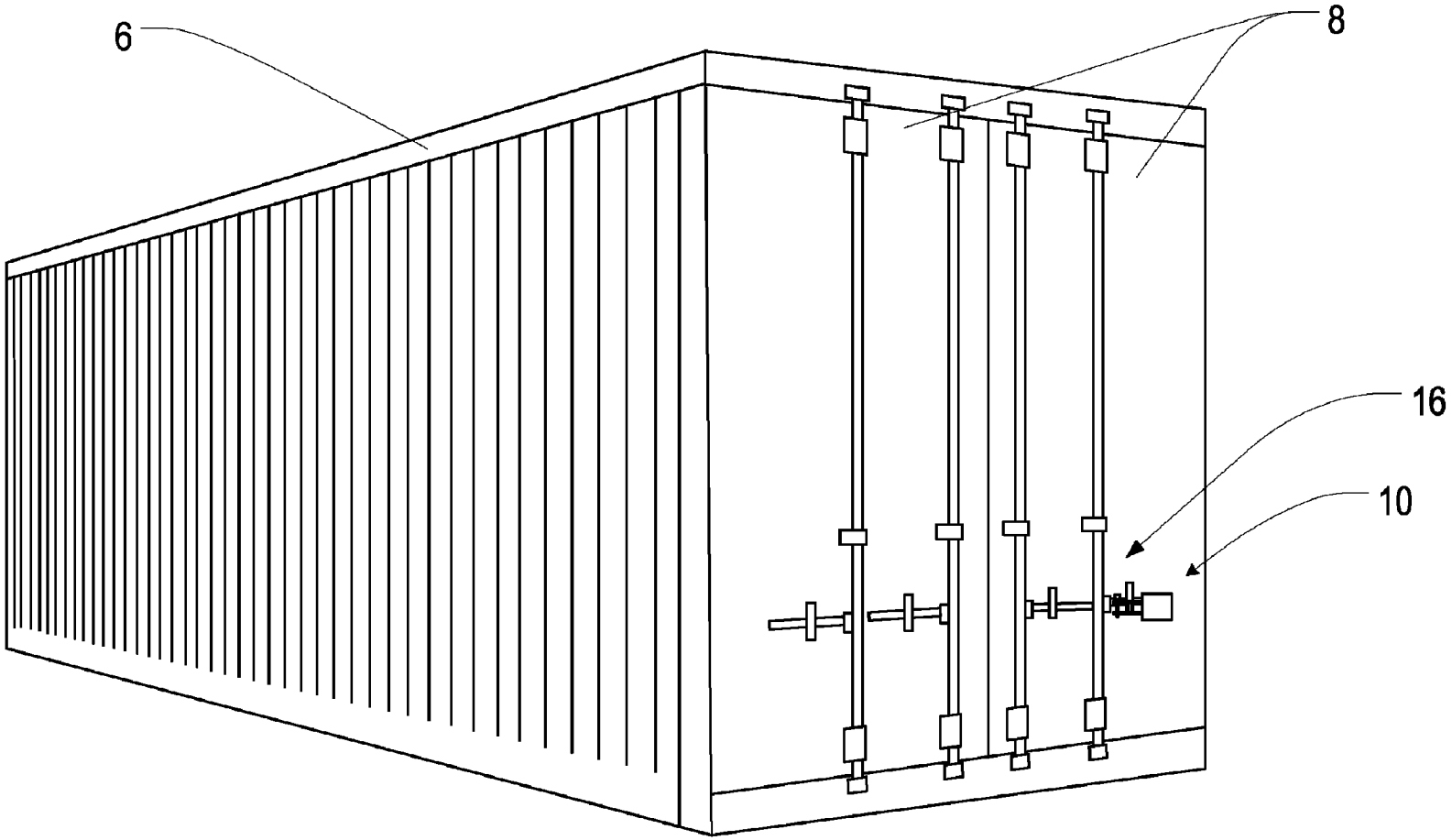
FIG. 1 is an illustration of a conventional shipping container having an electronic locking system installed thereon, for securing the container, in accordance with one or more aspects of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Figure 1A:
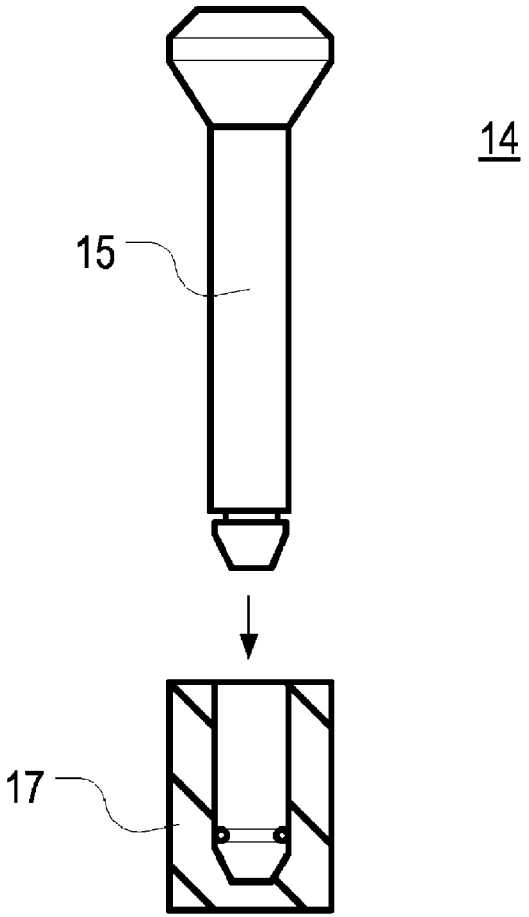
FIG. 1A is an illustration of a conventional bolt seal including a bolt and a locking housing assembly.

FIG. 1 is an illustration of a conventional shipping container 6 having an electronic locking system 10 installed thereon, for securing the container 6, in accordance with one or more aspects of the present invention. Such shipping containers conventionally utilize a latching assembly to maintain the container door or doors 8 in a closed state, and such latching assembly frequently includes a hasp mechanism 16. A bolt seal 14 commonly used to lock shipping container doors 8 is shown in FIG. 1A, and includes a bolt 15 and locking housing assembly 17.

Figure 2:
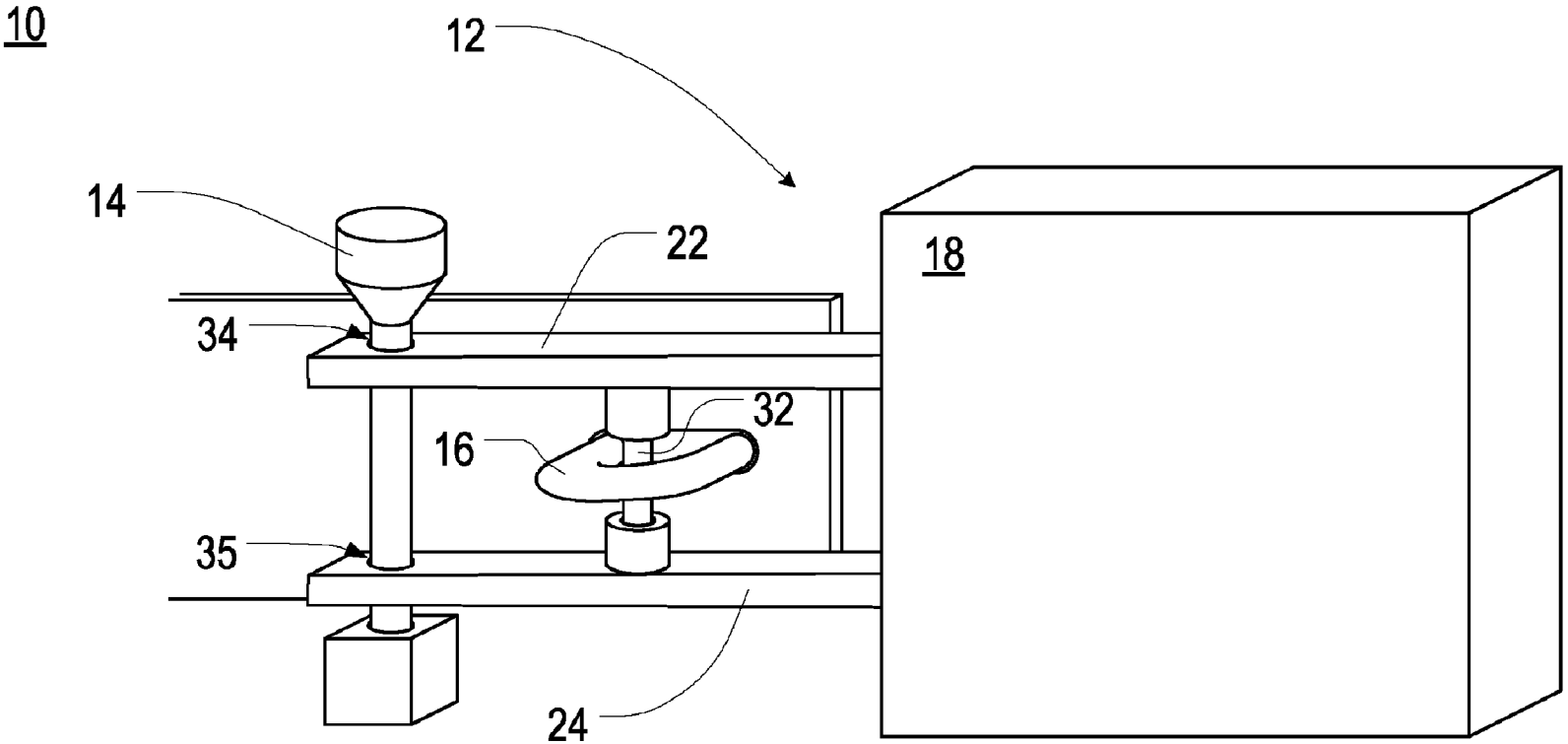
FIG. 2 is a schematic perspective illustration of a first variation of the electronic locking system of FIG. 1.

FIG. 2 is a schematic perspective illustration of a first variation of the electronic locking system 10 of FIG. 1. The system 10 includes an electronic locking device 12; a bolt seal 14; and a container hasp 16.

The container hasp 16 is found in the latching assemblies of conventional shipping containers. The bolt seal 14 also is conventional and preferably includes a mechanical bolt 15 and locking housing assembly 17, which are shown in FIG. 1A. Furthermore, a serial number may be printed on the bolt and on the locking housing. However, an electronic bolt seal may be used in conjunction with the invention, too.

The electronic locking device 12 includes a rugged mechanical housing 18 supporting an upper pivot arm 22 and a lower pivot arm 24. Each of these will be described in greater detail hereinbelow.

Figure 3:
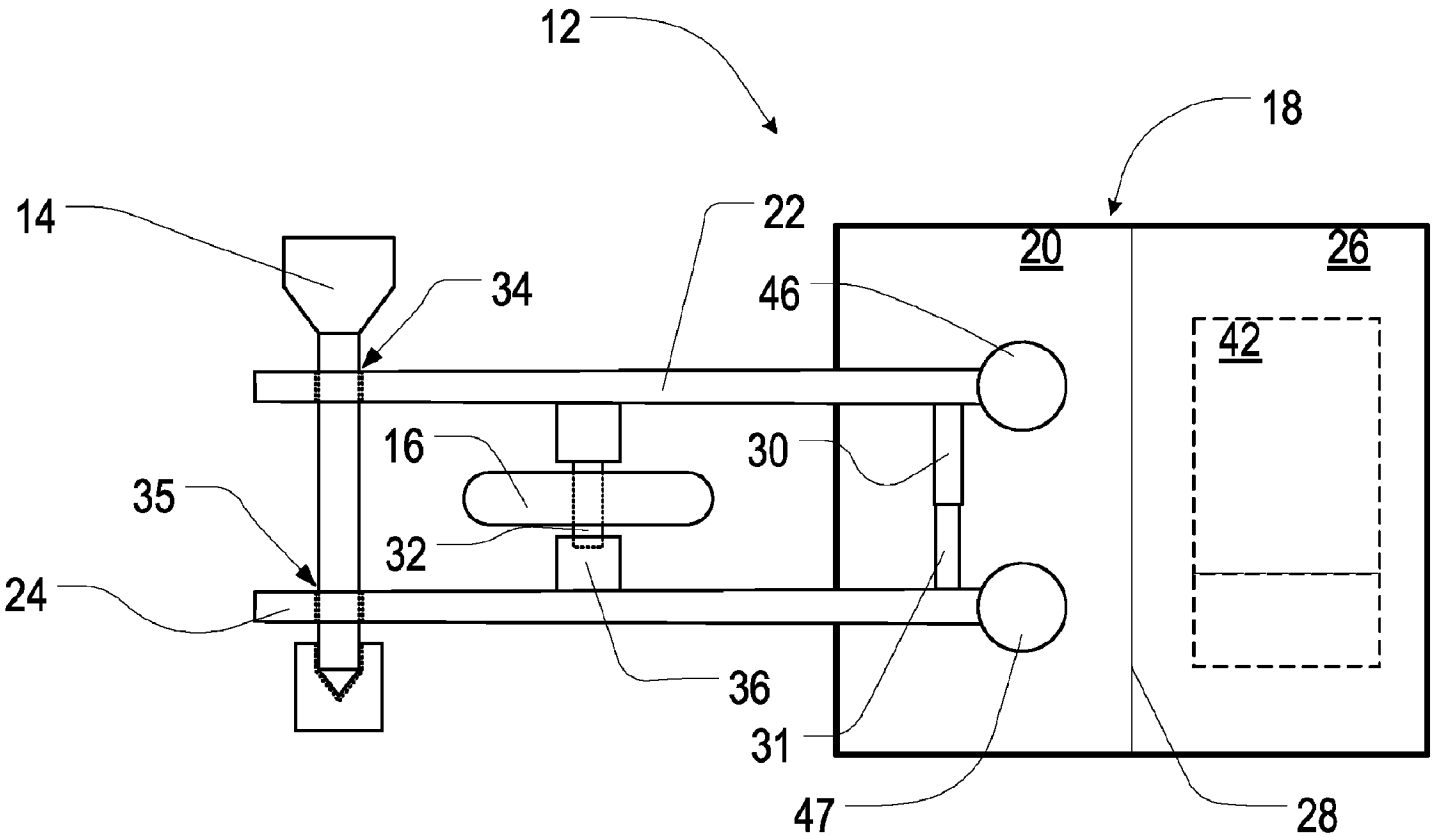
FIG. 3 is a more detailed schematic illustration of the electronic locking system of FIG. 1.
Figure 4:
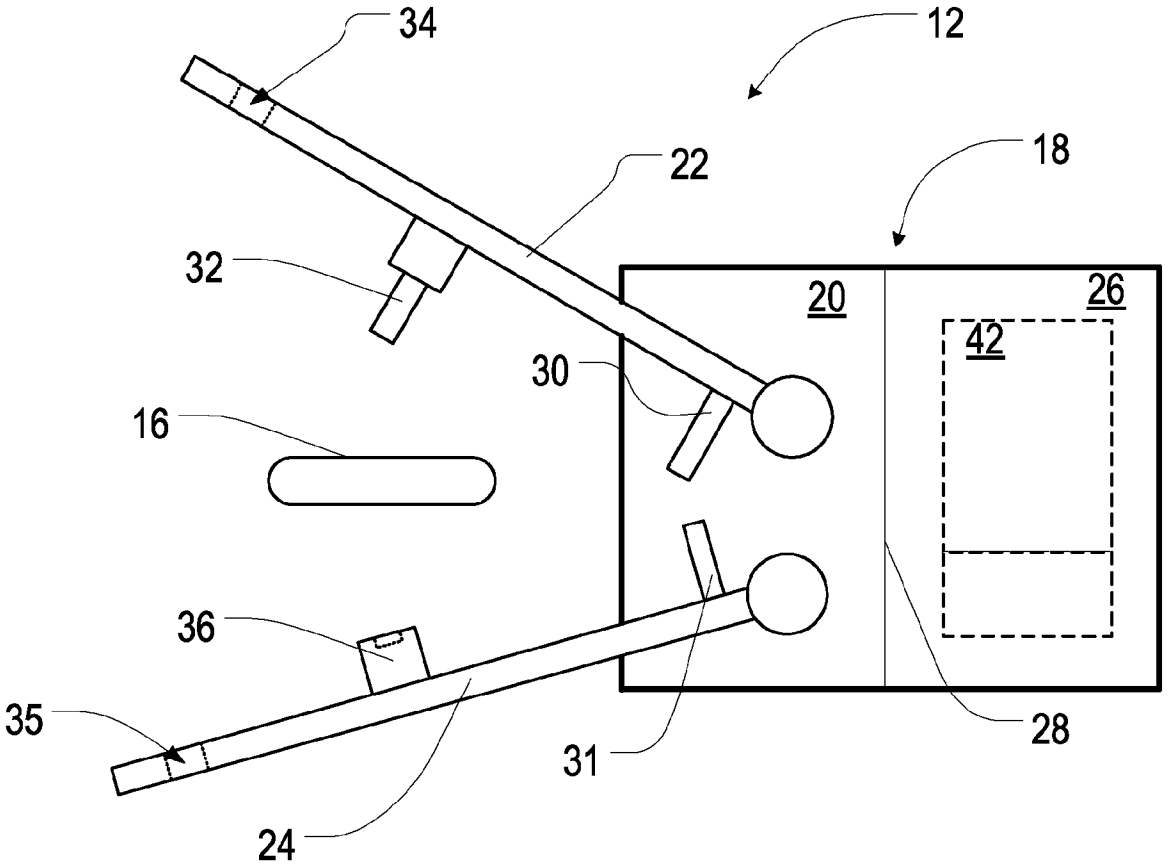
FIG. 4 is another schematic illustration of the electronic locking system of FIG. 3, shown in an unlocked configuration.

FIGS. 3 and 4 are more detailed schematic illustrations of the electronic locking system 10 of FIG. 1, shown in a locked configuration and an unlocked configuration, respectively. As shown therein, the housing 18 of the electronic locking device 12 includes a pivot arm support carriage 20, which is preferably enclosed except for the pivot arms 22,24 extending therefrom; a sealed compartment 26 containing sensor electronics (not shown, but schematically indicated in FIGS. 3-4) and one or more batteries (not shown, but schematically indicated in FIGS. 3-4); and a barrier 28 to prevent access to the electronics compartment 26 from the pivot arm support carriage 20. The housing 18 may be attached to the container 6 by any conventional means, such as by magnets, adhesive, bolts, or the like, and is preferably attached in a way so as not to damage the integrity of the container wall to which it is attached. Preferably, the housing 18 is attached to the container door 8 using rare earth magnets that are mounted in the housing 18.

The upper pivot arm 22 has a proximal end, which is located within the pivot arm support carriage 20, and a distal end. The upper pivot arm 22 pivots about a point located on or near its proximal end. In the first variation of the system 10, the upper pivot arm 22 includes the following features along its length, from proximal end to distal end: a pivot or swivel 46; a sensing contact 30, preferably disposed within the pivot arm support carriage 20, that closes a circuit when the electronic locking device 12 is in the locked configuration (as shown in FIGS. 2 and 3) and opens the circuit when the electronic locking device 12 is in the unlocked configuration (as shown in FIG. 4); a bolt or pin (hereinafter pin or bolt 32) that is inserted through the container hasp 16 to secure the container 6; and an opening 34 adapted to receive the bolt 15 of the bolt seal 14 therethrough.

The lower pivot arm 24 has a proximal end, which is located within the pivot arm support carriage 20, and a distal end. Like the upper pivot arm 22, the lower pivot arm 24 pivots about a point located on or near its proximal end. In the first variation of the system 10, the lower pivot arm 24 includes the following features along its length, from proximal end to distal end: a pivot or swivel 47; a sensing contact 31, preferably disposed within the pivot arm support carriage 20, that closes the pivot arm circuit, by making contact or coming in close proximity with the sensing contact 30 on the upper pivot arm 22, when the electronic locking device 12 is in the locked configuration (as shown in FIGS. 2 and 3) and opens the circuit when the electronic locking device 12 is in the unlocked configuration (as shown in FIG. 4), a bolt receptacle 36 that receives therein the bolt 32 inserted through the container hasp 16; and an opening 34 adapted to receive the bolt 15 of the bolt seal 14 therethrough.

In the locked configuration, shown in FIGS. 2 and 3, the bolt 15 of the bolt seal 14 has been inserted through the openings 34,35 of the pivot arms 22,24 and received in locking engagement within the locking housing assembly 17 of the bolt seal 14. Furthermore, because the pivot arms 22,24 have been rotated toward each other, the security bolt 32 has been inserted through the container hasp 16 and received within the bolt receptacle 36, and the sensing contacts 30,31 are placed in contact or sufficiently close disposition with each other so as to close the pivot arm circuit, thereby indicating that the locking arms 22,24 are closed. It further will be appreciated that the bolt 32 and bolt receptacle 36 function as a stop limiting the further closing of the arms 22,24. Moreover, the receipt of the bolt 32 through the hasp and within the bolt receptacle 36 precludes removal of the locking device from the hasp with the arms 22,24 are in the locked configuration.

In the unlocked configuration of the electronic locking device 12, shown in FIG. 4, the pivot arms 22,24 have been rotated away from each other; the security bolt 32 has been removed from the bolt receptacle 36 and the container hasp 16; and the sensing contacts 30,31 are out of contact or sufficiently far apart so as to open the pivot arm circuit, thereby indicating that the locking arms 22,24 are open. The locking arms 22,24 being open may, in turn, be interpreted by the sensor electronics 42, or by a human operator, to mean that the bolt seal 14 has been removed and that the container door 8 may have been opened.

The pivot arm circuit, of which the contacts 30,31 form a part, may be any circuitry adapted to detect, via the sensing contacts 30, an "open" state and a "closed" state. The sensing contacts 30,31 may be or include electrical contacts, optoelectronic contacts or sensors, magnetic reed switch contacts, proximity sensor or any other suitable electrical, mechanical, electromechanical, optoelectrical sensor or contact. The circuitry for detecting the binary ("open" or "closed") state may vary according to the sensor or contact design, based on power, space or circuit technology, or the like, so long as a binary input (representing "open" or "closed") is passed along to the sensor electronics 42.

The sensor electronics 42 may be any electronics adapted to relay or pass along state information about the pivot arm circuit to an external recipient, whether through digital or analog, wired or wireless signal or transmission, by audio or visual signal for perception by appropriate personnel, or the like, such as by electrical, optical or magnetic data link. The state information may include the existence of an "open" state in the pivot arm circuit, the existence of a "closed" state in the pivot arm circuit, or both; the transition from a "closed" state to an "open" state in the pivot arm circuit, an "open" state to a "closed" state in the pivot arm circuit, or both; or the like. In at least some embodiments, the state information alternatively or additionally includes information related to any of the foregoing, and may include information about multiple occurrences of any of the foregoing.

Such state information further may include, but is not limited to, the time of such transition, the duration of a state, the location of the device 12 at the time, or other conditions at the device 12 or within or without the container 6. Such information and conditions may be determined, detected, or the like using built-in or integrated circuitry or technology or may be relayed or reported to the sensor electronics 42 from separate components. In at least some embodiments, such information and conditions may be relayed through one or more communication devices, such as by "hopping." Various aspects of sensor electronics, sensors, and the like, suitable for use in the present invention, are disclosed in the aforementioned U.S. patent application Ser. No. 11/460,976, published as US 2008-0315596 A1 and issued as U.S. Pat. No. 7,828,342, as well as other of the incorporated references.

In particular, the device may be used to detect any opening or closing of the pivot arms 22,24, thus providing a strong indication as to whether the container door hasp 16 is secure. In particular, if the pivot arms 22,24 are opened (or are no longer closed), there is an excellent likelihood (although not conclusive in and of itself) that the container door 8 has been opened. This, in turn, may indicate to an operator that contents have been added to or removed from the container 6. The sensor electronics 42 preferably sense every opening and closing of the pivot arms 22,24; record the time of the event; and if within wireless transmission range of an applicable communication device (e.g., a reader), then report the event, or else store the information until such communications are available and the information can be reported.

Optionally, or alternatively, the information may not be wirelessly communicated from the electronic locking device 12 and, instead, acquired by download via a USB port or other interface. A locking housing assembly of a bolt seal, including a USB port, is disclosed, for example, in U.S. patent application Ser. No. 11/460,976, published as US 2008-0315596 A1 and issued as 7,828,342, as well as other of the incorporated references.

In an exemplary method of use, a human operator installs the electronic locking device 12 by opening the pivot arms 22,24 of the device 12 and positioning them above and below the staple portion of the hasp mechanism such that the bolt 32 may be inserted through the hasp 16. Once the bolt 32 is aligned with the hasp 16, the pivot arms 22,24 may be rotated toward each other such that the bolt 32 is guided through the hasp 16. The rotation of the pivot arms 22,24 also brings the contacts 30,31 together, placing them in contact or close disposition with each other and closing the pivot arm circuit, as described previously. The bolt 15 of a bolt seal 14 may then be installed through the openings 34 in the distal ends of the pivot arms 22,24, and conventional procedures for such installations are carried out.

When the container is to be opened, conventional procedures may be carried out with regard to the removal of the bolt seal 14. Once the bolt seal is removed, the pivot arms 22,24 of the device 12 may be opened once again, thereby retracted the bolt 32 from the hasp and permitting the device 12 to be removed therefrom. With the device 12 removed, the latching assembly of the shipping container 6 may be manipulated normally to permit opening of the door 8.

It will be appreciated that, in order to prevent tampering, the bolt 32 and the receptacle 36 may be designed so as to minimize the possibility that the bolt 32 is cut, broken, destroyed or its integrity is otherwise damaged, which would permit the device 12 from being removed from the hasp 16 without opening the pivot arms 22,24. The design may include particular geometries, materials, and the like to make it very difficult for an individual to gain access in this way.

Optionally or alternatively to the contacts 30,31, in a feature of the electronic locking device 12, the security bolt 32 and the bolt receptacle 36 may include contacts and serve to close the pivot arm circuit when the arms are in the closed position, and open the pivot arm circuit when the arms are in the open position. In this variation, contacts 30,31 as shown in FIGS. 2-4. This is somewhat disadvantageous, as the contacts are not enclosed and protected by the housing 18. However, this is somewhat advantageous because cutting of the bolt 32 for removal of the electronic locking device 12 (without removing the bolt seal 14) would then be detected, in that the cutting of the bolt or pin 32 would break the pivot arm circuit.

Figure 5:
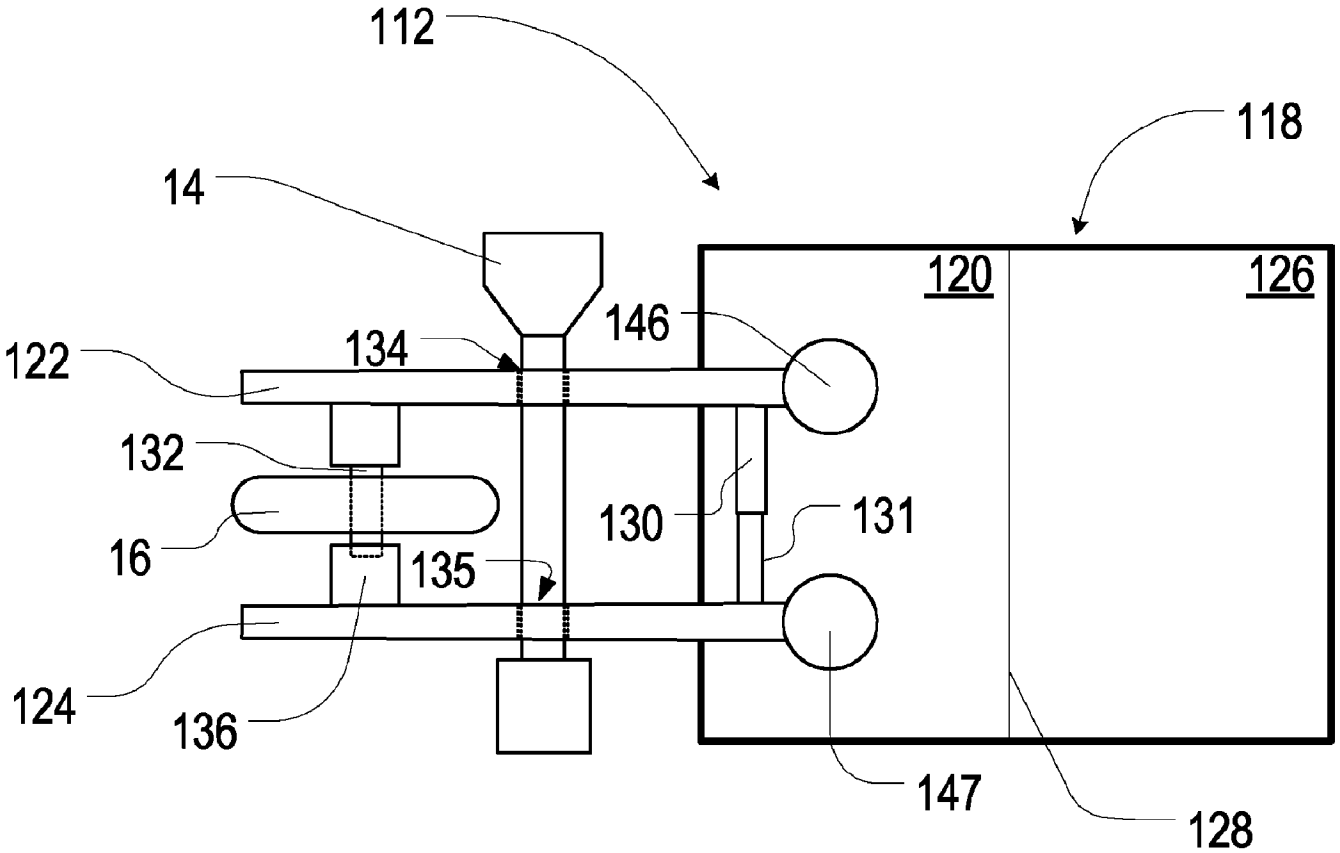
FIG. 5 is a schematic illustration of a second variation of an electronic locking system for securing a shipping container in a locked configuration, including a bolt located between the hasp and the seal housing, in accordance with or more aspects of the present invention.

FIG. 5 is a schematic illustration of a second variation of an electronic locking system 110 for securing a shipping container 6 in a locked configuration in accordance with one or more aspects of the present invention. The system 110 includes an electronic locking device 112; bolt seal 14; and container hasp 16. The electronic locking device 112 includes a rugged mechanical housing 118 supporting an upper pivot arm 122 and a lower pivot arm 124. The rugged mechanical housing 118 includes: a pivot arm support carriage 120, which is preferably enclosed except for the pivot arms 122, 124 extending therefrom; a sealed compartment 126 containing sensor electronics (not shown, but schematically indicated in FIGS. 3-4) and one or more batteries (not shown, but schematically indicated in FIGS. 3-4); and a barrier 128 to prevent access to the electronics compartment 126 from the pivot arm support carriage 120.

The upper pivot arm 122 has a proximal end, which is located within the pivot arm support carriage 120, and a distal end. The upper pivot arm 122 pivots about a point located on or near its proximal end. In the second variation of the system 110, the upper pivot arm 122 includes the following features along its length, from proximal end to distal end: a pivot or swivel 146; a sensing contact 130, preferably disposed within the pivot arm support carriage 120, that closes a circuit when the electronic locking device 112 is in a locked configuration (as shown in FIG. 5) and opens the circuit when the electronic locking device 112 is in an unlocked configuration (not shown); an opening 134 adapted to receive the bolt of a bolt seal 14 therethrough; and a bolt or pin 132 that is inserted through the container hasp 16 to secure the container 6.

The lower pivot arm 124 has a proximal end, which is located within the pivot arm support carriage 120, and a distal end. Like the upper pivot arm 122, the lower pivot arm 124 pivots about a point located on or near its proximal end. In the second variation of the system 110, the lower pivot arm 124 includes the following features along its length, from proximal end to distal end: a pivot or swivel 146; a sensing contact 130, preferably disposed within the pivot arm support carriage 120, that closes the pivot arm circuit, by making contact or coming in close proximity with the sensing contact 131 on the upper pivot arm 122, when the electronic locking device 112 is in a locked configuration (as shown in FIG. 5) and opens the circuit when the electronic locking device 112 is in an unlocked configuration (not shown); an opening 134 adapted to receive the bolt 15 of a bolt seal 14 therethrough; and a bolt receptacle 136 that receives the bolt or pin 132 inserted through the container hasp 16.

In the locked configuration, shown in FIG. 5, the bolt 15 of the bolt seal 14 has been inserted through the openings 134, 135 of the pivot arms 122,124 and received in locking engagement within the locking housing assembly 17 of the bolt seal 14. Furthermore, because the pivot arms 122,124 have been rotated toward each other, the security bolt or pin 132 has been inserted through the container hasp 16 and engaged with the bolt receptacle 136, and the sensing contacts 130,131 are placed in contact or close disposition with each other, thereby closing the pivot arm circuit and indicating that the locking arms 122, 124 are closed.

Figure 6:
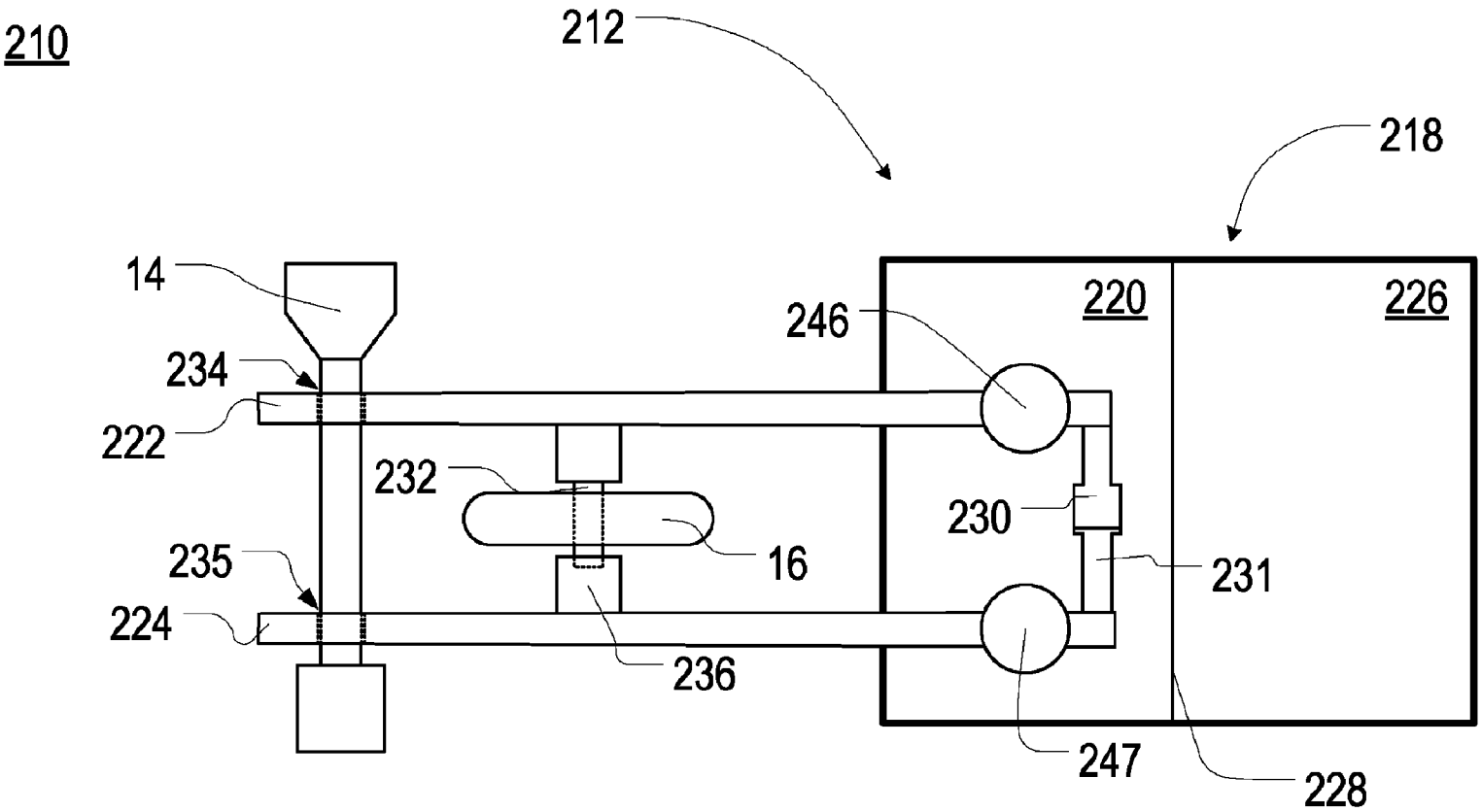
FIG. 6 is a schematic illustration of a third variation of an electronic locking system for securing a shipping container in a locked configuration, including sensor contacts on the reverse side of the arm pivot points, in accordance with or more aspects of the present invention.

FIG. 6 is a schematic illustration of a third variation of an electronic locking system 210 for securing a shipping container 6 in a locked configuration in accordance with one or more aspects of the present invention. The system 210 includes: an electronic locking device 212; a bolt seal 14; and a container hasp 16. The electronic locking device 212 includes a rugged mechanical housing 218 supporting an upper pivot arm 222 and a lower pivot arm 224. The rugged mechanical housing 218 includes: a pivot arm support carriage 220, which is preferably enclosed except for the pivot arms 222,224 extending therefrom; a sealed compartment 226 containing sensor electronics (not shown, but schematically indicated in FIGS. 3-4) and one or more batteries (not shown, but schematically indicated in FIGS. 3-4); and a barrier 228 to prevent access to the electronics compartment 226 from the pivot arm support carriage 220.

The upper pivot arm 222 has a proximal end, which is located within the pivot arm support carriage 220, and a distal end. The upper pivot arm 222 pivots about a point located on or near its proximal end. In the third variation of the system 210, the upper pivot arm 222 includes the following features along its length, from proximal end to distal end: a sensing contact 230 within the pivot arm support carriage 220 that closes a circuit when the electronic locking device 212 is in a locked configuration (as shown in FIG. 6) and opens the circuit when the electronic locking device 212 is in an unlocked configuration (not shown); a pivot or swivel 246; a bolt or pin 232 that is inserted through the container hasp 16 to secure the container 6; and an opening 234 adapted to receive the bolt of a bolt seal 14 therethrough.

The lower pivot arm 224 has a proximal end, which is located within the pivot arm support carriage 220, and a distal end. Like the upper pivot arm 222, the lower pivot arm 224 pivots about a point located on or near its proximal end. In the third variation of the system 210, the lower pivot arm 224 includes the following features along its length, from proximal end to distal end: a sensing contact 230 within the pivot arm support carriage 220 that closes the pivot arm circuit, by making contact or coming in close proximity with the sensing contact 231 on the upper pivot arm 222, when the electronic locking device 212 is in a locked configuration (as shown in FIG. 6) and opens the circuit when the electronic locking device 212 is in an unlocked configuration (not shown); a pivot or swivel 247, a bolt receptacle 236 that receives the bolt or pin 232 inserted through the container hasp 16; and an opening 234 adapted to receive the bolt of a bolt seal 14 therethrough.

In the locked configuration, shown in FIG. 6, the bolt 15 of the bolt seal 14 has been inserted through the openings 234, 235 of the pivot arms 222,224 and received in locking engagement within the locking housing assembly 17 of the bolt seal 14. Furthermore, because the pivot arms 222,224 have been rotated toward each other, the security bolt or pin 232 has been inserted through the container hasp 16 and engaged with the bolt receptacle 236, and the sensing contacts 230 are placed in contact or close disposition with each other, thereby closing the pivot arm circuit and indicating that the locking arms 222, 224 are closed.

In order to make it possible to open the pivot arms 222,224 a sufficient distance to permit the bolt or pin 232 to be inserted through the hasp 16, it will be understood that the respective contacts 230,231 are offset from one another such that rotation of the pivot arms 222,224 into the closed position causes adjacent sides of the contacts 230, rather than ends thereof, to be placed in abutment or proximity with each other, in a motion that in some ways may be similar to the closing of a pair of scissors. Suitable geometry for such an arrangement will be apparent to the Ordinary Artisan.

Figure 7:
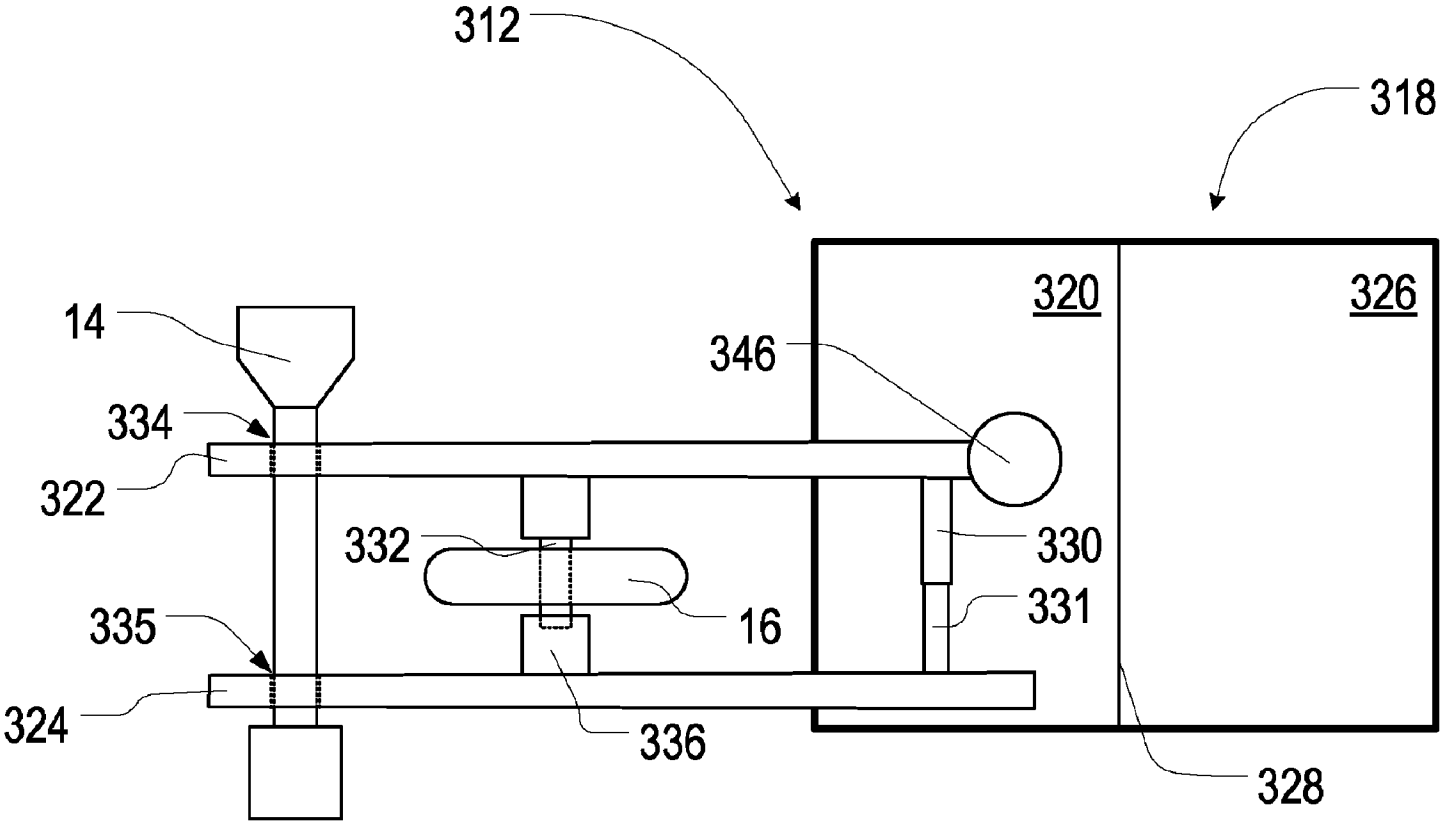
FIG. 7 is a schematic illustration of a fourth variation of an electronic locking system for securing a shipping container in a locked configuration, including an arrangement in which the lower arm is fixed with only the upper arm able to pivot, in accordance with or more aspects of the present invention.

FIG. 7 is a schematic illustration of a fourth variation of an electronic locking system 310 for securing a shipping container 6 in a locked configuration in accordance with one or more aspects of the present invention. The system 310 includes: an electronic locking device 312; a bolt seal 14; and a container hasp 16. The electronic locking device 312 includes: a rugged mechanical housing 318 supporting an upper pivot arm 322; and a lower fixed arm 324. The rugged mechanical housing 318 include: a pivot arm support carriage 320, which is preferably enclosed except for the upper pivot arm 322, and lower fixed arm 324 extending therefrom; a sealed compartment 326 containing sensor electronics (not shown, but schematically indicated in FIGS. 3-4) and one or more batteries (not shown, but schematically indicated in FIGS. 3-4); and a barrier 328 to prevent access to the electronics compartment 326 from the pivot arm support carriage 320.

The upper pivot arm 322 has a proximal end, which is located within the pivot arm support carriage 320, and a distal end. The upper pivot arm 322 pivots about a point located on or near its proximal end. In the fourth variation of the system 310, the upper pivot arm 322 includes the following features along its length, from proximal end to distal end: a pivot or swivel 346; a sensing contact 330, preferably disposed within the pivot arm support carriage 320, that closes a circuit when the electronic locking device 312 is in a locked configuration (as shown in FIG. 7) and opens the circuit when the electronic locking device 312 is in an unlocked configuration (not shown); a bolt or pin 332 that is inserted through the container hasp 16 to secure the container 6; and an opening 334 adapted to receive the bolt of a bolt seal 14 therethrough.

The lower fixed arm 324 has a proximal end, which is located within the pivot arm support carriage 320, and a distal end. Unlike the upper pivot arm 322, the lower pivot arm 324 does not pivots about a point located on or near its proximal end, but rather, is fixed in place. In the fourth variation of the system 310, the lower fixed arm 324 includes the following features along its length, from proximal end to distal end: a sensing contact 331; preferably disposed within the pivot arm support carriage 320, that closes the pivot arm circuit, by making contact or coming in close proximity with the sensing contact 330 on the upper pivot arm 322, when the electronic locking device 312 is in a locked configuration (as shown in FIG. 7) and opens the circuit when the electronic locking device 312 is in an unlocked configuration (not shown); a bolt receptacle 336 that receives the bolt or pin 332 inserted through the container hasp 16; and an opening 335 adapted to receive the bolt 15 of the bolt seal 14 therethrough.

In the locked configuration, shown in FIG. 7, the bolt 15 of the bolt seal 14 has been inserted through the opening 334 of the pivot arm 322, inserted through the opening 335 of the fixed arm 324, and received in locking engagement within the locking housing assembly 17 of the bolt seal 14. Furthermore, when the upper pivot arm 322 has been rotated toward the lower fixed arm 324, the security bolt or pin 332 has been inserted through the container hasp 16 and engaged with the bolt receptacle 336, and the sensing contacts 330 are placed in contact with or sufficiently close proximity to each other so as to close the pivot arm circuit, thereby indicating that the locking arms 322,324 are closed.

In an alternative embodiment to that of the electronic locking device 312, the upper arm is fixed and the lower arm rotates in otherwise similar manner and enabled by similar structure to that of the electronic locking device 312.

Figure 8:
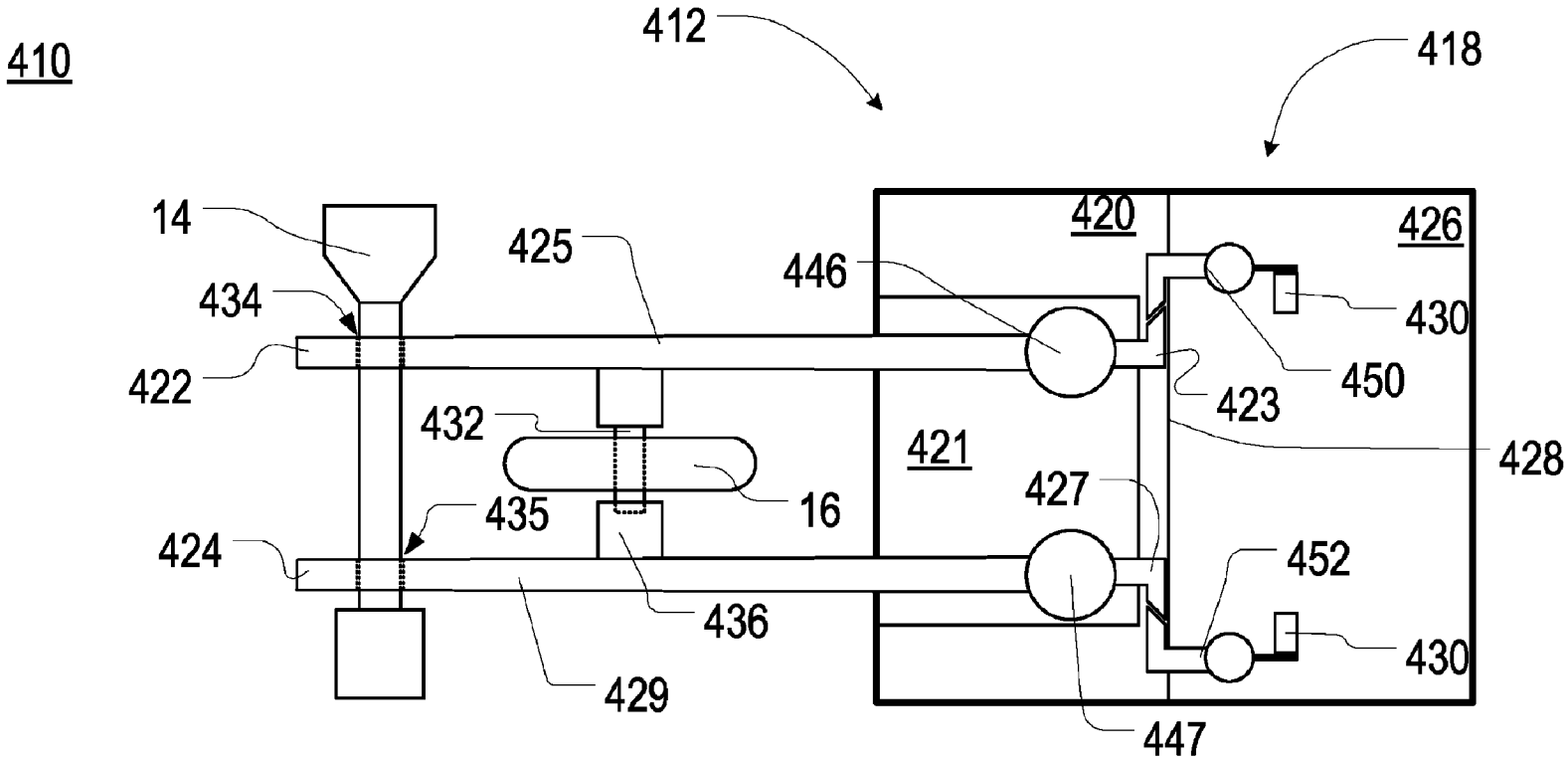
FIG. 8 is a schematic illustration of a fifth variation of an electronic locking system for securing a shipping container in a locked configuration, including an arrangement in which the pivot arm or arms could be removed from the seal housing entirely, in accordance with or more aspects of the present invention.

FIG. 8 is a schematic illustration of a fifth variation of an electronic locking system 410 for securing a shipping container 6 in a locked configuration in accordance with one or more aspects of the present invention. The system 410 includes an electronic locking device 412; a bolt seal 14; and container hasp 16. The electronic locking device 412 includes a removable pivot arm assembly 421 supporting an upper pivot arm 422 and a lower pivot arm 424, and a rugged mechanical housing 418. The rugged mechanical housing 418 includes: a pivot arm support carriage 420, into which the removable pivot arm assembly 421 can be inserted; a compartment 426 containing sensor electronics (not shown, but schematically indicated in FIGS. 3-4) and one or more batteries (not shown, but schematically indicated in FIGS. 3-4); an upper pivoting member 450; a lower pivoting member 452; and a barrier 428 that partially limits access to the electronics compartment 426 from the pivot arm support carriage 420. The upper and lower pivoting members 450,452 are anchored within the compartment 426 and extend across the barrier 428 into the pivot arm support carriage 420, where they engage the pivot arms when the system 410 is in a locked configuration, as shown in FIG. 8.

In the fifth variation of the system 410, the upper pivot arm 422 is supported by the removable pivot arm assembly 421; has two arm segments 423,425 both of which extend from the pivot arm assembly 421; and pivots about a point located within the pivot arm assembly 421. The shorter of the arm segments 423,425 ends extends into the pivot arm support carriage 420 when the pivot arm assembly 421 is inserted into the housing 418 and engages with the upper pivoting member 450 to secure the removable pivot arm assembly 421 within the pivot arm support carriage 420. The longer arm segment 425 of the upper pivot arm 422 includes the following features along its length, extending away from the pivot arm assembly 421: a bolt or pin 432 that is inserted through the container hasp 16 to secure the container 6; and an opening 434 adapted to receive the bolt 15 of a bolt seal 14 therethrough.

The lower pivot arm 424 also is supported by the removable pivot arm assembly 421; has two arm segments 427,429 both of which extend from the pivot arm assembly 421; and, like the upper pivot arm 422, pivots about a point located within the pivot arm assembly 421. The shorter of the arm segments 427 extends into the pivot arm support carriage 420 when the pivot arm assembly 421 is inserted into the housing 418 and engages with the lower pivoting member 452 to secure the removable pivot arm assembly 421 within the pivot arm support carriage 420. The longer arm segment 429 of the lower pivot arm 424 includes the following features along its length, extending away from the pivot arm assembly 421: a bolt receptacle 436 that receives the bolt or pin 432 inserted through the container hasp 16; and an opening 434 adapted to receive the bolt 15 of the bolt seal 14 therethrough.

Within the electronics compartment 426, the upper and lower pivoting members 450,452 are located near sensing contacts 430. When the electronic locking device 412 is in a locked configuration (as shown in FIG. 8), engagement by the ends of the arm segments 423,427 cause the pivoting members 450,452 to pivot such that contact is made with the sensing contacts 430, whereby the pivot arm circuit of the electronic locking device 410 is closed.

Figure 9:
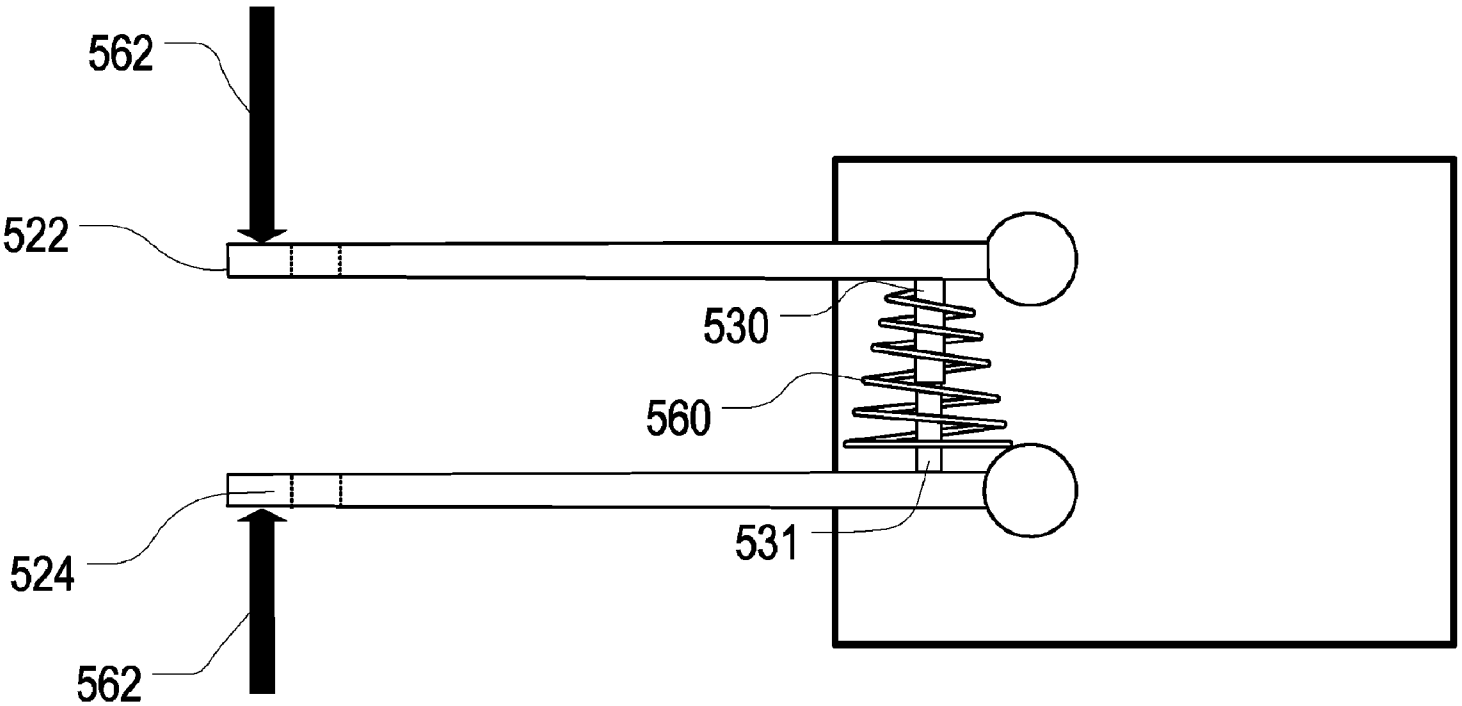
FIG. 9 is a schematic illustration of a sixth variation of an electronic locking system for securing a shipping container in a locked configuration, including a spring assembly added to the housing, in accordance with or more aspects of the present invention.
Figure 10:
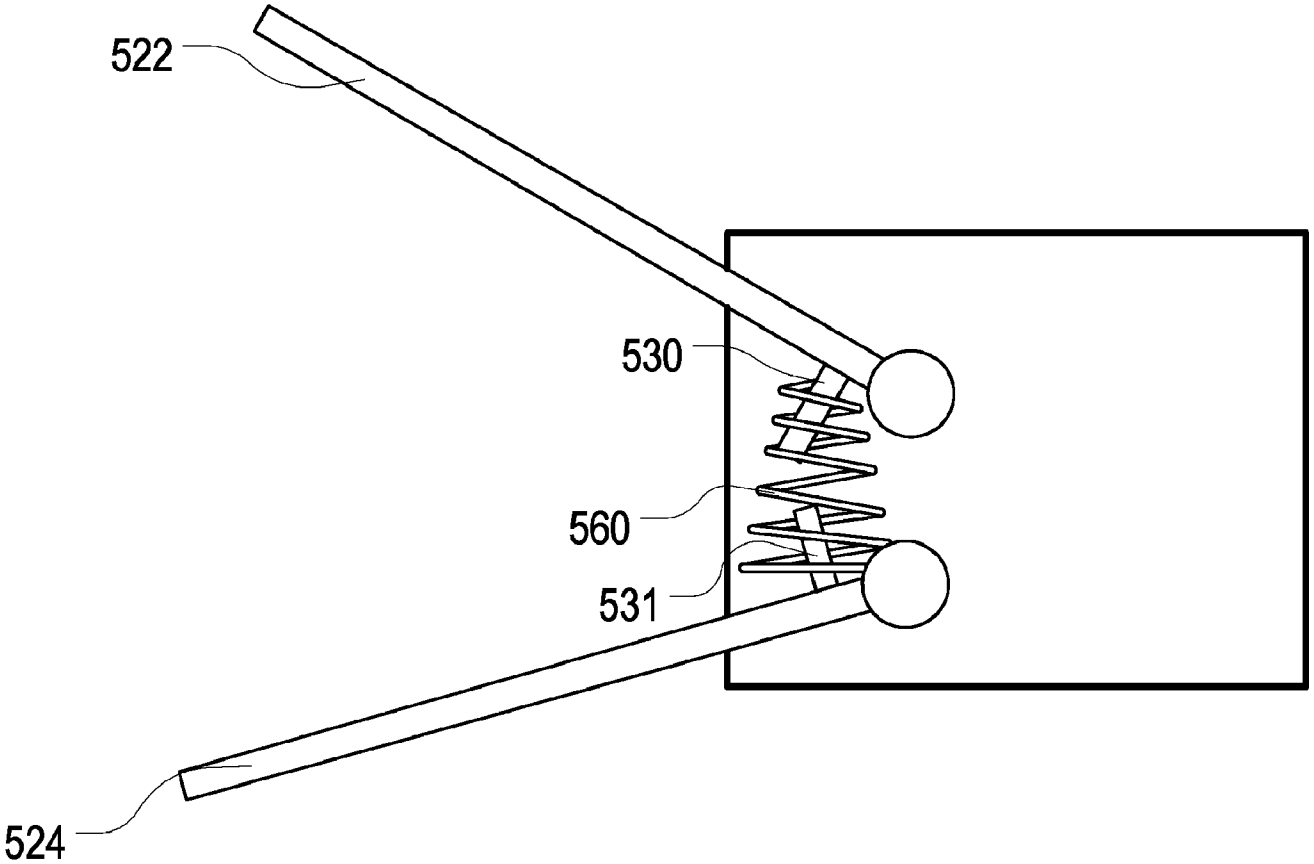
FIG. 10 is a schematic illustration of the electronic locking system of FIG. 9, shown in an unlocked position.
Figure 11:
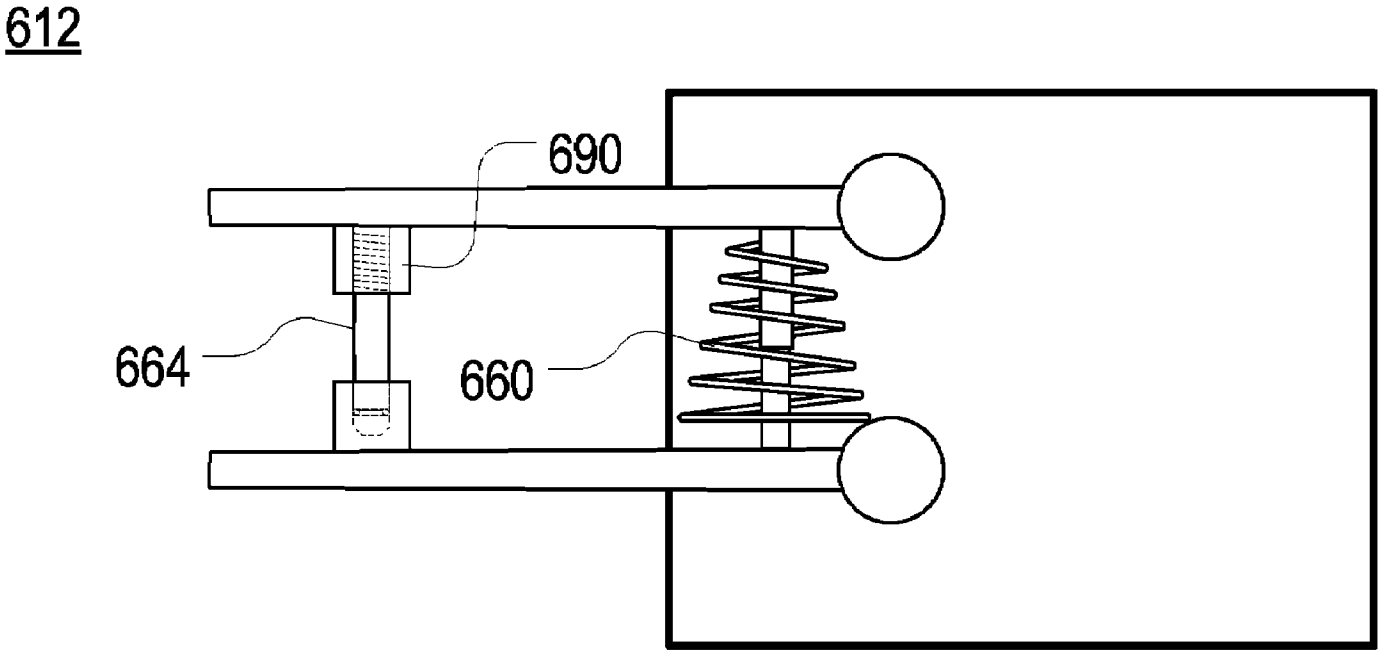
FIG. 11 is a schematic illustration of a particular implementation of the electronic locking system of FIG. 9, including a bolt for holding the two pivot arms together.

FIGS. 9-11 are schematic illustrations of a further variation of an electronic locking device 512 for securing a shipping container 6 in a locked configuration in accordance with one or more aspects of the present invention. The structure of the device 512 is similar to the device 12 of FIGS. 2-4, and for brevity, only differences in the two devices 12,512 are described and shown in FIGS. 9-10.

In particular, the electronic locking device 512 includes a compression spring 560 that biases the pivot arms 522,524 apart, toward the open position. The compression spring 560 is schematically shown encompassing the contacts 530,531; however, it is contemplated that the compression spring may not encompass the contacts 530,531 while still serving to bias the pivot arms 522,524 toward the open position. When the electronic locking device 512 is in the closed configuration, the bolt seal 14 holds the arms in the closed position against the force of the compressed spring 512, as represented by the opposed arrows 562 shown in FIG. 9. The electronic locking device 512 is schematically shown in a closed or locked configuration in FIG. 9 and in an open or unlocked configuration in FIG. 10. Furthermore, it will be understood and appreciated that any of the foregoing embodiments of the electronic locking device may include a spring for tensioning of the device into an open or unlocked configuration.

Finally, FIG. 11 illustrates a specific variant of the electronic locking device having a compression spring 660, wherein the bolt or pin 664 is received within the bolt receptacle in locking engagement therewith, whereby a bolt seal 14 is unnecessary. In this case, the bolt or pin 664 holds the pivot arms closed against the force of the spring 660 when in the closed configuration. The bolt or pin 664 also is cut in order to return the electronic locking device 612 to the open or unlocked configuration. Moreover, the cut remnants of the bolt or pin 664 preferably are readily removed and replaced with a new bolt or pin for relocking of the device 612. For instance, the upper end of the bolt or pin 664 may be received in threaded engagement within the subcomponent 690 and readily unscrewed after cutting of the bolt or pin.

Finally, it will be noted that one or more of the foregoing embodiments may be utilized not only with hasps of door latching assemblies of shipping containers, but in other ways, such as in combination with a lid or other element of a shipping conveyance.

It will be apparent to the Ordinary Artisan that the various features, variations, methods of use, implementations, sensor electronics functionality, and the like, described previously with regard to FIGS. 2-4, are equally applicable, except where by their nature such applicability is inappropriate, to the other variations described herein with reference to FIGS. 5-11.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. An electronic locking device for securing a shipping container, comprising:

(a) a housing including an electronics compartment;

(b) a pair of arms, extending from the housing and adapted to couple to a hasp on a shipping container, wherein at least one of the arms is configured to pivot, relative to the other of the arms, such that the arms transition between a locked configuration and an unlocked configuration;

(c) a sensing circuit that is in a "closed" state when the pair of arms are in the locked configuration and is in an "open" state when the pair of arms is in the unlocked configuration; and (d) electronics housed in the electronics compartment that detect whether the sensing circuit is in the "closed" state or the "open" state;

(e) wherein the output of the electronics represents an indication of whether the arms are in the locked configuration or the unlocked configuration.

2. The electronic locking device of claim 1, wherein the housing further includes a support carriage and a barrier to prevent access to the electronics compartment from the support carriage.

3. The electronic locking device of claim 1, wherein the electronics record the state of the sensing circuit.

4. The electronic locking device of claim 1, wherein the electronics record the state of the sensing circuit in a computer-readable medium that is contained in the electronics compartment.

5. The electronic locking device of claim 1, wherein the electronics report the state of the sensing circuit.

6. The electronic locking device of claim 1, wherein the electronics report the state of the sensing circuit through wireless communications.

7. The electronic locking device of claim 1, wherein the arms are configured to concurrently receive a bolt therethrough when in the locked configuration.

8. The electronic locking device of claim 1, wherein a bolt of a bolt seal extends through a respective opening in each of the arms and retains the arms in the locked configuration.

9. The electronic locking device of claim 1, wherein the arms are configured to be maintained in the locked configuration by a bolt seal.

10. The electronic locking device of claim 1, wherein the sensing circuit includes sensing contacts located in or on the pair of arms.

11. The electronics locking device of claim 10, wherein a sensing contact on one of the arms comes into contact with, or sufficiently close to, a sensing contact on the other arm when the arms are in the locked configuration.

12. The electronic locking device of claim 1, wherein:

(a) a first arm pivots around a point within the support carriage;

(b) the second arm is fixed in place;

(c) the sensing circuit includes sensing contacts that extend from portions of the arms interior to the housing;

(d) a bolt is attached to and projects from one of the arms and is located exterior to the housing; and (e) a bolt receptacle is attached to and projects from the other of the arms exterior to the housing, and is configured to receive therein the projecting bolt when the arms are in the locked configuration.

13. The electronic device of claim 12, wherein each of the arms has an opening configured to concurrently receive therethrough a bolt of a bolt seal.

14. The electronic locking device of claim 1, wherein (a) the arms pivot about pivot axes within the housing;

(b) the sensing circuit includes sensing contacts that extend from portions of the arms interior to the housing;

(c) a bolt is attached to and projects from one of the arms and is located exterior to the housing; and (d) a bolt receptacle is attached to and projects from the other of the arms exterior to the housing.

15. The electronic device of claim 14, wherein each of the arms has an opening configured to concurrently receive therethrough a bolt of a bolt seal.

16. The electronic locking device of claim 14, wherein the bolt seal openings are located further from the housing along the arms than the location of the bolt and bolt receptacle.

17. The electronic locking device of claim 14, wherein the bolt and bolt receptacle are located further from the housing along the arms than the location of the bolt seal openings.

18. The electronic locking device of claim 14, wherein both arms pivot about respective pivot axes within the housing, and wherein the pivot axes are located between sensing contacts of the sensing circuit and the bolt and bolt receptacle.

19. The electronic locking device of claim 1, wherein the arms are carried by a pivot arm assembly that is removably received and retained within the housing.

20. The electronic locking device of claim 1, further comprising a spring located within the housing and configured to bias the arms toward the unlocked configuration.

21. The electronic locking device of claim 20, wherein:

(a) a bolt extends from a first arm, of the pair of arms, and is adapted to extend through the hasp;

(b) in the locked configuration, the presence of the bolt, extending through the hasp, prevents the hasp from being opened;

(c) one of the arms includes a bolt receptacle adapted to receive and retain the distal end of the bolt; and (d) the securing of the bolt within the bolt receptacle provides a force sufficient to retain the arms in the locked configuration against the force of the spring.

* * * * *